US006723496B2

(12) United States Patent
Sato et al.

(10) Patent No.: US 6,723,496 B2
(45) Date of Patent: Apr. 20, 2004

(54) SILVER HALIDE PHOTOGRAPHIC MATERIAL

(75) Inventors: Tadanobu Sato, Kanagawa (JP); Takahiro Matsuno, Kanagawa (JP); Tadashi Inaba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/789,802

(22) Filed: Feb. 22, 2001

(65) Prior Publication Data

US 2001/0021492 A1 Sep. 13, 2001

(30) Foreign Application Priority Data

Feb. 22, 2000 (JP) ..... P.2000-044482
Mar. 14, 2000 (JP) ..... P.2000-070751

(51) Int. Cl.[7] ..... G03C 1/09
(52) U.S. Cl. ..... 430/605; 430/567; 430/569
(58) Field of Search ..... 430/567, 569, 430/605

(56) References Cited

U.S. PATENT DOCUMENTS 4,548,888 A * 10/1985 Crawley ..... 430/223
5,360,712 A 11/1994 Olm et al. ..... 430/567
6,352,823 B1 * 3/2002 Sato ..... 430/605
6,372,419 B1 * 4/2002 Inaba et al. ..... 430/567
6,403,294 B2 * 6/2002 Sato ..... 430/567

FOREIGN PATENT DOCUMENTS

JP 5-341426 12/1993 ..... G03C/1/09
JP 11-102042 4/1999 ..... G03C/1/08
JP 2000-241924 * 9/2000
JP 2000-338621 * 12/2000

OTHER PUBLICATIONS

English abstract of JP 2000–338621.*

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

A silver halide photographic material comprising a support having thereon at least one silver halide emulsion layer, wherein the material is contained at least one complex selected from complexes having a compound represented by the following formula (I) as at least one of their respective ligands or complexes having a diketone compound as at least one of their respective ligands:

(I)

wherein X represents an atom or atomic group bridging two pyridine rings, each of $R_1$ to $R_4$ represents a hydrogen atom or a substituent group, and each of $R_1'$ to $R_2'$ represents a hydrogen atom or a substituent group.

17 Claims, No Drawings

SILVER HALIDE PHOTOGRAPHIC MATERIAL

FIELD OF THE INVENTION

The present invention relates to a silver halide photographic material and, more particularly, to a highly sensitive silver halide photographic material utilizing a dopant art.

BACKGROUND OF THE INVENTION

There are known the arts of modifying silver halide grains so as to bring about improvements as intended in properties of a silver halide photographic material in its entirety. One of such arts is the art of incorporating a substance (a dopant) other than silver and halide ions into silver halide grains (the art of doping). In particular, many pieces of research have been done on the art of doping silver halide grains with transition metal ions. As a result, it is widely recognized that the photographic properties can be modified effectively by transition metal ions brought in silver halide grains as a dopant even if the ions are added in a very slight amount.

For increasing sensitivities of silver halide emulsions, it is known to utilize the arts of doping silver halide grains with not only transition metal ions but also transition metal complexes formed with cyanide ions as ligands. In particular, there are many disclosures regarding the emulsions increased in sensitivity by being doped with the group VIII metal complexes (in the periodic table) which each contain 6 cyanide ions as ligands. As dopants containing cyanide ions, for instance, JP-B-48-35373 (the term "JP-B" as used herein means an "examined Japanese patent publication") discloses potassium ferrocyanide as a hexacyanoferrate(II) complex salt and potassium ferricyanide as a hexacyanoferrate(III) complex salt. In the reference described above, however, the sensitivity-increasing effect is confined to the cases using the iron ion-containing dopants, irrespective of the species of ligands. There are many other disclosures regarding emulsions acquiring high sensitivities by being doped with hexacyanoferrate(II) complex salts. For instance, such emulsions are disclosed in JP-A-5-66511 (the term "JP-A" as used herein means an "unexamined published Japanese patent application") and U.S. Pat. No. 5,132,203. Further, highly sensitive emulsions doped with cyano-complexes besides iron complexes are known. For example, JP-A-2-20853 discloses that highly sensitive emulsions are obtained when silver iodochloride comprised therein are doped with cyano-rhenium complexes, cyano-ruthenium complexes, cyano-osmium complexes and cyano-iridium complexes respectively. Many of complexes formed by other metal ions are also used as dopants, and can produce not only the sensitivity increasing effect but also a wide variety of effects including improvement of reciprocity (law) failure and increasing contrast. U.S. Pat. No. 2,448,060 discloses that emulsions are sensitized when doped with platinum(II) or palladium(IV) complexes containing halogen ions as ligands. U.S. Pat. No. 3,790,390 describes the emulsions doped with cyano-cobalt(III) complex in addition to emulsions doped with cyano-iron(II) complexes and those doped with cyano-iron(III) complexes, and discloses silver halide emulsions containing spectral sensitizing dyes. The silver halide grains formed in the presence of a rhodium(III) complex having 3, 4, 5 or 6 cyano ligands are disclosed in U.S. Pat. No. 4,847,191. Those patents prove that the dopants can diminish high intensity reciprocity (law) failure. The silver halide emulsions doped with rhenium, ruthenium, osmium or iridium complexes having at least 4 cyano ligands are disclosed in European Patent 0,336,425, European Patent 0,336,426, and JP-A-2-20854. Therein, it is described that the doped emulsions are improved in storage stability of sensitivity and gradation, and improved in low intensity reciprocity (law) failure. European Patent 0,336,427 and JP-A-2-20852 disclose the silver halide emulsions doped respectively with six-coordinated vanadium, chromium, manganese, iron, ruthenium, osmium, rhenium and iridium complexes containing nitrosyl or thionitrosyl ligands. By the use of such complexes, those patents achieve improvement in low intensity reciprocity (law) failure without lowering medium illumination sensitivity. As to the dopants other than transition metal ions, the emulsions doped with bismuth or lead ions are disclosed in U.S. Pat. No. 3,690,888, and the emulsions containing the group XIII and XIV metal ions (in the periodic table) respectively are disclosed in JP-A-7-128778.

Among the ligands of complexes used as dopants, the most frequently used ligand is supposed to be cyanide ion, but halogen ions are also used frequently. As examples of dopant complexes having a $[MCl_6]^{n-}$ structure, wherein M is an arbitrary metal, mention may be made of hexachlororuthenate, hexachloroiridate, hexachlororhodate and hexachlororhenate disclosed, e.g., in JP-A-63-184740, JP-A-1-285941, JP-A-2-20852 and JP-A-2-20855. Further, European Patent 0,336,689 and JP-A-2-20855 disclose as dopants the six-coordinated rhenium complexes formed with halogeno, nitrosyl, thionitrosyl, cyano, water or/and thiocyano ligands. Furthermore, as emulsions having useful photographic properties, the emulsion wherein is incorporated a six-coordinated transition metal complex having one carbonyl ligand and the emulsion wherein is incorporated a six-coordinated transition metal complex having two oxo ligands are disclosed in JP-A-3-118535 and JP-A-3-118536 respectively.

As described above, complexes used as dopants are various in their central metal ions and their ligands. In recent years have been disclosed the arts of reforming emulsions by doping the silver halide grains with complexes containing organic compounds as ligands. For instance, the use of various complexes containing organic compounds as ligands is disclosed in U.S. Pat. Nos. 5,360,712, 5,457,021 and 5,462,849, European Patent 0,709,724, JP-A-7-72569 and JP-A-8-179452. In these patents, it is described that sensitivity increasing effect becomes great in particular when $[(NC)_5Fe(\mu\text{-}4,4'\text{-bipyridine})Fe(CN)_5]^{6-}$ is used for doping, while high intensity reciprocity (law) failure can be improved notably by using iridium complexes, such as $[IrClr_5(\text{thiazole})]^{2-}$. JP-A-11-24194 makes the emulsions improved in both sensitivity and reciprocity (low) failure by using $[Fe(CO)_4(P(Ph)_3)]^0$ or $[Fe(CO)_3(P(Ph)_2)]^0$ for doping them. In addition, JP-A-11-102042 obtains highly sensitive emulsions when the complexes used as dopants are represented by formulae $[M(CN)_5L]^{3-}$ ($M=Fe^{2+}$, $Ru^{2+}$, $Ir^{2+}$), $[Fe(CO)_4L]^0$, $[M'(CN)_3L]^-$ ($M'=Pd^{2+}$, $Pt^{2+}$) and $[IrCl_5L]^{2-}$ respectively, and besides, the ligand L therein is 2-mercaptobenzimidazole, 5-methyl-s-triazolo(1,5-A)pyrimidine-7-ol or 2-mercapto-1,3,4-oxadiazole. Further, JP-A-10-293377 discloses emulsions doped with $[RuCl_5L']^{2-}$ (L'=imidazole, benzimidazole or a derivative thereof). Those emulsions have extremely increased contrast, and the sensitivities thereof are substantially increased, compared with those of the emulsions using dopants known to cause desensitization and increasing contrast. Almost all ligands present in the complexes used in the references described above form coordination bonds via their respective nitrogen atoms. On the other hand, there are few dopants forming coordination bonds via the oxygen atoms in their ligands, and no cases are known yet wherein the complexes forming coordination bonds via the oxygen atoms of ketone ligands are used as dopants.

When six-coordinated complexes having an octahedron structure are incorporated as dopants in silver halide grains, some units $[AgX_6]^{-5}$ (X=halide ion) in the silver halide grains are replaced by the complex molecules as described in a large literature, including *J. Phys.: Condens. Matter,* 9 (1997) 3227–2240, and many patents. In such replacement, it is supposed that the central metal ions occupy the lattice positions of silver ions ($Ag^+$) and the ligands occupy the lattice positions of halide ions. Therefore, U.S. Pat. No. 5,360,712 describes that it is necessary for the complex used as a dopant to have halide or pseudo-halide ions at more than half of the coordination sites to the central metal, and besides, the organic compounds as the residual ligands are required to have a molecular size appropriate for a size of the space in the crystal lattice playing a host to the replacement.

On the other hand, U.S. Pat. No. 3,672,901, JP-A-2-259749 and JP-A-4-336537 disclose the cases wherein complexes having neither halide ions nor pseudo-halide ions at the coordination sites to their respective central metal ions, such as $[Fe(EDTA)]^{2-}$ (wherein EDTA means ethylenediaminetetra-acetic acid) and $[Fe(C_2O_4)_3]^{3-}$, are used as dopants. However, U.S. Pat. No. 5,360,712 described above describes that those complexes don't have great dopant effect. This is because all the coordination sites therein are occupied by organic compound molecules and no room is left for halide or pseudo-halide ions necessary to incorporate complexes in silver halide grains, so they are unsuitable as dopants. Further, JP-A-5-341426 has a description of the emulsions to which complexes including $[Ru(bpy)_2Cl_2]^0$ (wherein bpy means 2,2'-bipyridine) are added. According to the reference described above, these complexes also don't have large effect when they are added during the grain formation, but they can produce large effect when they are added to the grain surface together with dyes after grain formation.

As described above, in order to enable the complexes having organic compound molecules as ligands to function as dopants when incorporated in silver halide grains, the occupation sites of organic compound molecules are limited to only one or two of the six coordination sites to the central metal. No cases are known yet which bring about desirable changes in photographic characteristics by incorporating in silver halide grains a complex wherein more than half or all of the coordination sites are occupied by organic compound molecules.

Besides the incorporation of dopants, chemical sensitization is required for making highly sensitive emulsions. What is representative of the chemical sensitization is gold sensitization. When emulsions are doped with cyano complexes, as described in JP-A-8-62761, the cyanide ions liberated from the cyano complexes are adsorbed to emulsion grain surfaces and react with gold ion added as a chemical sensitizer to form a cyano-gold complex; as a result, the formation of sensitized nuclei by the gold sensitizer is inhibited. For effecting gold sensitization of cyano complex-doped emulsions, therefore, it is necessary to dope the subsurface with the cyano complex and thereby to keep the cyano groups away from the silver halide grain surface, as described in U.S. Pat. No. 5,132,203 and European Patent 0,508,910. In addition, the method of adding ions, e.g., zinc ion, for preventing the inhibition of gold sensitization is disclosed in JP-A-6-308653. Thus, it is required to adopt an additional means in order that compatibility is established between gold sensitization and elevation of sensitivity by the hitherto used dopant arts which depend on cyano complexes.

Under the conditions of the present invention, most of the dopants capable of ensuring a significant increase in sensitivity are complexes having cyanide ions as ligands, so the cyanide's strong toxicity problem remains even when the inhibition of gold sensitization by cyanide ions can be overcome. Such being the case, cyanide ion-free dopants capable of conferring highly increased sensitivity on emulsions are desired.

SUMMARY OF THE INVENTION

Therefore, an object of the present invention is to provide a silver halide photographic material having higher sensitivity than before without incorporating cyanide ions therein.

This object is attained with the following silver halide photographic materials (1) to (13).

(1) A silver halide photographic material which comprises a support having thereon at least one silver halide emulsion layer, with the material containing at least one complex selected from complexes having a compound represented by the following formula (I) as at least one of their respective ligands or complexes having a diketone compound as at least one of their respective ligands:

(I)

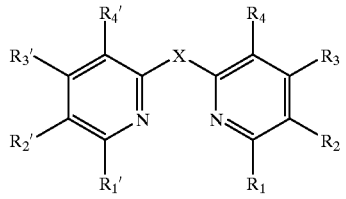

wherein X represents an atom or atomic group bridging two pyridine rings, each of $R_1$ to $R_4$ represents a hydrogen atom or a substituent group, and each of $R^{1'}$ to $R^{4'}$ represents a hydrogen atom or a substituent group.

(2) The silver halide photographic material as described in (1), wherein the complex having a compound represented by formula (I) as at least one ligand thereof is a metal complex containing organic compounds, inclusive of a compound represented by formula (I), in a state that they are bound respectively to more than half of coordination sites to a central metal thereof.

(3) The silver halide photographic material as described in (2), wherein the complex having at least one ligand represented by formula (I) is a complex represented by the following formula (II), (III) or (IV):

| | |
|---|---|
| $[M(L)_3]^{n+}$ | (II) |
| $[M(L)_2L']^{n+}$ | (III) |
| $[M(L)_2Y_2]^{n+}$ | (IV) |

wherein M represents a metal or a metal ion, L represents a compound of formula (I), L' represents a bidentate ligand, Y represents monodentate ligand, and n represents an integer of from −6 to 6.

(4) The silver halide photographic material as described in (3), wherein the X in formula (I) comprises an atom or atomic group selected from the group consisting of carbon, nitrogen, sulfur, phosphorus, silicon, selenium and tellurium atoms and structured so as to bridge the two pyridine rings.

(5) The silver halide photographic material as described in (4), wherein the X in formula (I) is a group selected from methylene, amine, sulfide, sulfoxide, phosphine, silane, selenide, telluride, secondary alcohol, ketone or aminoalkyl.

(6) The silver halide photographic material as described in (5), wherein the central metal M in each of formulae (II) to (IV) is a metal or a metal ion selected from the group consisting of iron, ruthenium, cobalt, nickel, copper and ions of these metals.

(7) The silver halide photographic material as described in (1), wherein the complex containing a diketone compound as at least one ligand thereof is incorporated in the silver halide emulsion and the diketone compound coordinates as a bidentate ligand to a central metal ion of the complex via oxygen atoms in ketone moieties thereof.

(8) The silver halide photographic material as described in (7), wherein the complex incorporated in the silver halide emulsion is a complex containing at least two molecules of the diketone compound as ligands thereof.

(9) The silver halide photographic material as described in (8), wherein the diketone compound contained as ligands in the complex is a β-diketone or a γ-diketone.

(10) The silver halide photographic material as described in (9), wherein the diketone compound contained as ligands in the complex is a β-diketone.

(11) The silver halide photographic material as described in (10), wherein the complex incorporated in the silver halide emulsion is a complex whose central metal is a metal or a metal ion selected from the group consisting of alkaline earth metals, the first transition series metals, the second transition series metals, lanthanide metals, iridium, platinum, zinc, aluminum, tin and ions of these metals.

(12) The silver halide photographic material as described in (11), wherein the complex incorporated in the silver halide emulsion is a complex containing three molecules of the β-diketone as ligands thereof.

(13) The silver halide photographic material as described in (12), wherein the complex incorporated in the silver halide emulsion is a complex whose ligands are acetylacetone molecules and whose central metal is a metal or metal ions selected from the group consisting of alkaline earth metal, vanadium, manganese, iron, cobalt, nickel, palladium, platinum, gold, zinc, titanium, chromium (exclusive of chromium (II)), osmium, cadmium, mercury, yttrium, ruthenium, rhodium, lanthanum, cerium, praseodymium, europium, gadolinium, dysprosium, holmium, erbium, ytterbium, iridium, copper, and aluminum and ions of these metals.

DETAILED DESCRIPTION OF THE INVENTION

As described in *Bulgarian Chem. Commun.,* 20(1993) 350–368, *Radiat. Eff. Defects Solids,* 135(1995) 101–104, and *J. Phys.: Condens. Matter,* 9(997) 3227–3240, shallow electron traps arising from a Coulomb field are introduced into silver halide grains by doping with a hexacyano complex. Further, *ICPS,* 1998, *Final Program and Proceedings,* Vol., 1, p. 89, *ICPS,* 1998, *Final Program and Proceedings,* Vol., 1, p. 92, and JP-A-8-286306 describe that, when the central atom used for such a complex is a divalent metal ion, such as $Fe^{2+}$ or $Ru^{2+}$, in particular, excess charge of +1 is brought into a grain environment constituted of $Ag^+$ and $Cl^-$ to form a coulombic center and this coulombic center introduces photoelectron traps having an appropriate depth in silver chloride grains; as a result, the time lapsing before inactivation of photoelectrons generated by exposure is extended to increase the photographic speed to a considerable extent. Therein, the cyanide ions used as ligands produce a strong ligand-field effect. More specifically, π-bonds are formed by donating electrons to the cyano ligands from the central metal (back donation), and these bonds bring about further stabilization of the $t_{2g}$ orbital, a reduction in metal-ligand distance and an increase in effective positive charge of the metal ion. As a result, an effect of causing a great split in the d orbitals of the metal is produced, and thereby the $e_g$ orbital (the lowest unoccupied molecular orbital) of the complex introduced as a dopant comes to have higher energy than the bottom of the conduction band of the silver halide grains, so the energy level thereof becomes unrelated to trapping of photoelectrons. Only when such a state of energy levels are created, shallow electron traps arising from a coulombic center can be formed in the vicinity of each dopant.

Heterocyclic compounds, especially 1,10-phenanthroline and 2,2'-bipyridine, are generally known to bring about a strong ligand-field effect at the time of complexation. The strength of their ligand-field effects is comparable to that of cyano complexes. Therefore, in analogy with cyano complexes, it is supposed that, when silver halide grains are doped with a metal complex of heterocyclic compounds, the lowest unoccupied molecular orbital of such a complex can be put on an energy level higher than that of the bottom of the conduction band of silver halide. On the other hand, it can be expected that, if the lowest unoccupied molecular orbital of a complex introduced as dopant can be situated right under the conduction band of silver halide, it can be utilized directly as shallow electron traps and thereby highly sensitive emulsions will be obtained. Thus, freely controlling electronic conditions (energy levels) of complexes used as dopants is necessary and very significant for designing emulsions.

In the case of complexes containing heterocyclic compounds as ligands, for instance, the energy levels of the complexes under doping can be controlled by designing each ligand so that properly chosen species of substituents are arranged at the right positions. Based on a knowledge that heterocyclic compounds which can be coordinated to metal as bidentate ligands, such as 1,10-phenanthroline and 2,2'-bipyridine, produce strong ligand-field effect, we have got an idea that the energy levels of a complex containing a 2,2'-bipyridine compound as a ligand can be controlled effectively by inserting a certain substituent between the two pyridine rings. In the case of di-2-pyridylamine having an NH linkage between the two pyridine rings, the π acceptability of the ligand is actually increased as described in *Inorg. Chem.,* 1984, 23, 3010–3017, and *Hunan Shifan Daxue Ziran Kexue Xuebao,* 1998, 21, 53–56. Accordingly, it can be expected that the lowest unoccupied molecular orbital of the complex is elevated.

Considered from a standpoint of the grain structure around a complex incorporated as a dopant in silver halide grains, one-to-one replacement of $[AgX_6]^{5-}$ units (wherein X is a halide ion) in silver halide grains by complex molecules as in the cases of $[Fe(CN)_6]^{4-}$ and the like described in many references, inclusive of *J. Phys.: Condens. Matter,* 9 (1997) 3227–3240, is thought to cause a considerable distortion in the complex molecules when the complex contains a heterocyclic compound as a ligand. Unless Ag ions around the $[AgX_6]^{5-}$ unit join additionally in the replacement, it is necessary for the complex molecule incorporated as a dopant to withstand the considerable distortion. In this respect, the complexes formed by utilizing ligands whose constituent rings are linked by a substituent group capable of relaxing the distortion caused by doping are advantageous over the complexes formed by ligands required to be highly planar, such as 1,10-phenanthroline and 2,2'-bipyridine.

The complexes suitable for the present invention are complexes formed by using a compound of formula (I) as at least one of their respective ligands. And it is preferable that the residual coordination sites be occupied by inorganic anions capable of providing a great ligand-field effect, such as cyanide ions, or more than half of the residual coordination sites be occupied by organic compound molecules, especially heterocyclic compound molecules. A main reason for preferring heterocyclic compounds as the residual ligands is that they don't weaken the ligand-field effect as in the case of cyanide ions. Further, in the case of using Ru complexes formed with those preferable ligands, the central Ru atom does not take a trivalent state that provides a deep electron trap to constitute a desensitization factor, but the state of Ru(II) can be maintained. Additionally, the term "organic compound" as used herein refers to the compound whose parent compound is a chain or cyclic hydrocarbon some hydrogen or carbon atoms of which may be substituted with other atoms or atomic group.

The two pyridine rings in formula (I) are bridged by a single atom, plural atoms, or a substituent group. Suitable examples of a single atom serving as a bridge between two pyridine rings include chalcogen atoms, especially sulfur, selenium and tellurium. Two or more of atoms of the same species may be linked to one after another. When the two pyridine rings are bridged by atoms or a substituent group, it is preferable for each pyridine ring to bind to carbon, nitrogen, phosphorus or silicon. Suitable examples of a substituent group as the bridge include methylene, ethylene, a secondary alcohol, ketone, amine, phosphine, silane and phosphoric acid groups. In addition, the bridge may comprise a metal or metal ion forming a four-coordinated complex, such as gold.

$R_1$ to $R_4$ and $R_1'$ to $R_4'$ attached to the pyridine rings in formula (I) are each a hydrogen atom or a substituent group. The substituent groups present on the pyridine rings may be the same or different. Suitable examples of such substituent groups include a substituted or unsubstituted alkyl group (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl, methanesulfonylaminomethyl), an alkenyl group, an alkynyl group, an aralkyl group, a cycloalkyl group (e.g., cyclohexyl, 4-t-butylcyclohexyl), a substituted or unsubstituted aryl group (e.g., phenyl, p-tolyl, p-anisyl, p-chlorophenyl, 4-t-butylphenyl, 2,4-di-t-amylphenyl), a halogen atom (e.g., fluorine, chlorine, bromine, iodine), a cyano group, a nitro group, a mercapto group, a hydroxyl group, an alkoxy group (e.g., methoxy, butoxy, methoxyethoxy, dodecyloxy, 2-ethylhexyloxy), an aryloxy group (e.g., phenoxy, p-tolyloxy, p-chlorophenoxy, 4-t-butylphenoxy), an alkylthio group, an aryltho group, an acyloxy group, a sulfonyloxy group, a substituted or unsubstituted amino group (e.g., amino, methylamino, dimethylamino, anilino, N-methylanilino), an ammonio group, a carbonamido group, an sulfonamido group, an oxycarbonylamino group, an oxysulfonylamino group, a substituted ureido group (e.g., 3-methylureido, 3-phenylureido, 3,3-dibutylureido), a thioureido group, an acyl group (e.g., formyl, acetyl), an oxycarbonyl group, a substituted or unsubstituted carbamoyl group (e.g., ethylcarbamoyl, dibutylcarbamoyl, dodecyloxypropylcarbamoyl, 3-(2,4-di-t-aminophenoxy) propylcarbamoyl, piperidinocarbonyl, morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid group or a salt thereof, a sulfonic acid group or a salt thereof, and a phosphonic acid group or a salt thereof. In addition, it is also favorable that some pairs of substituent groups, $R_1$ and $R_2$, $R_2$ and $R_3$, $R_3$ and $R_4$, $R_1'$ and $R_2'$, $R_2'$ and $R_3'$, $R_3'$ and $R_4'$, or/and $R_4$ and $R_4'$, may combine with each other to form saturated carbon rings, aromatic carbon rings or heterocyclic aromatic rings.

The central metals suitable for complexes usable as dopants in the present invention are metals capable of forming 6-coordinated complexes having octahedral complex structures. Considered from a standpoint of the structure of a complex under the incorporation in silver halide grains, it can be said that metals or metal ions forming 4-coordinated complexes planar in structure are also suitable. Further, the central metals preferred in the present invention are metals of the type which satisfy a condition that, when the ligand-field splitting is caused in the d orbitals, the orbitals stabilized thereby are all filled with electrons. In addition, metals or metal ions having no unpaired electrons are also preferable. In particular, metals or metal ions not only satisfying the aforementioned condition on their d orbitals but also having no unpaired electrons are preferred. Examples of the metal and ions thereof include alkaline earth metal, iron, ruthenium, manganese, cobalt, rhodium, iridium, vanadium, yttrium, lanthanum, cerium, praseodymium, europium, gadolinium, dysprosium, holmium, erbium, ytterbium, copper, nickel, palladium, platinum, gold, zinc, titanium, chromium (exclusive of chromium(II)), osmium, cadmium, aluminum and mercury and ions thereof. Of these metal ions, iron, ruthenium, manganese, cobalt, rhodium, iridium, titanium, chromium and osmium ions are preferred. In particular, iron, ruthenium, cobalt, rhodium and iridium ions are preferred.

Examples of a complex used as a dopant in the present invention are illustrated below. However, the compounds usable in the present invention should not be construed as being limited to these complexes.

$[M(L)_3]^{n+}$ $[M(L)_2L']^{n+}$ $[M(L)_2Y_2]^{n+}$

L =

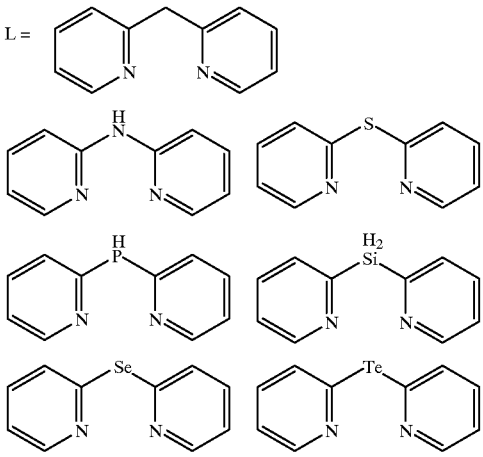

-continued
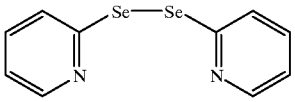
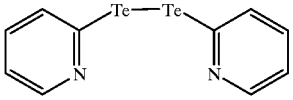
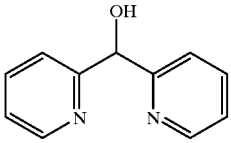
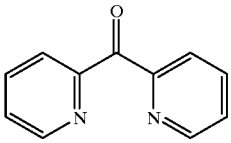
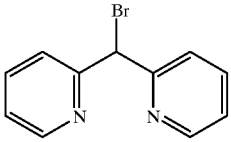
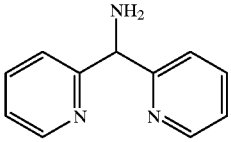
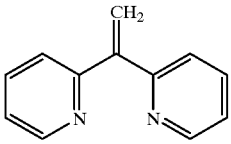
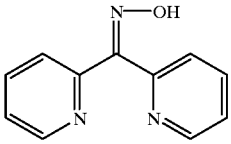
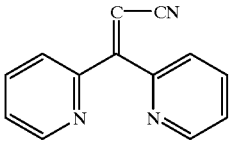
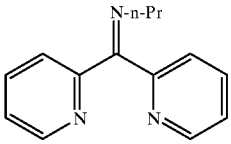
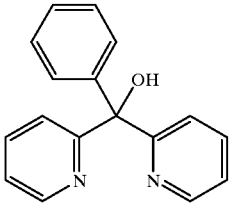
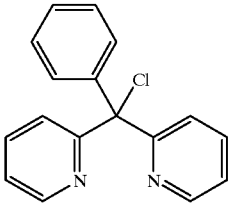
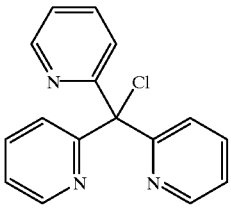
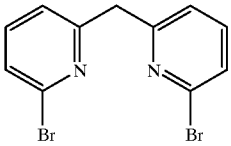
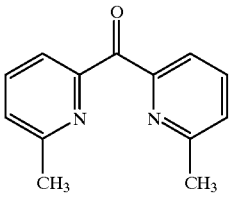
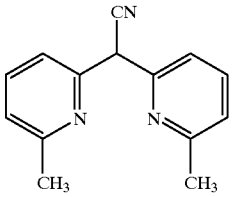
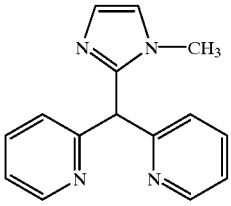
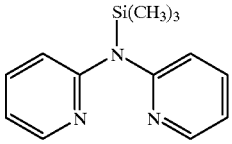
-continued
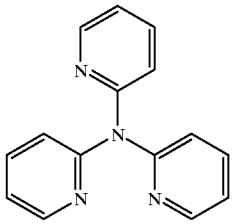
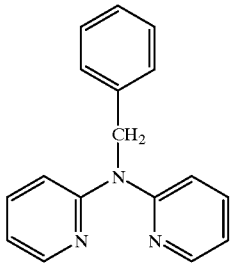
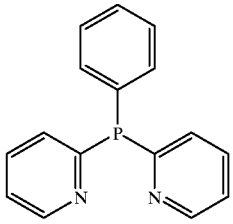
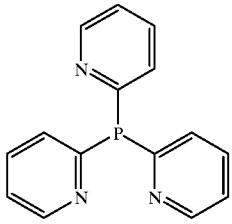
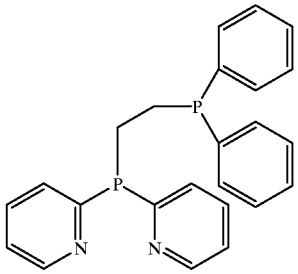
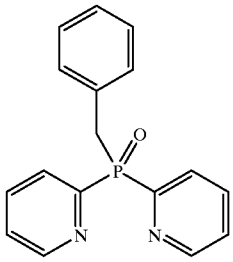
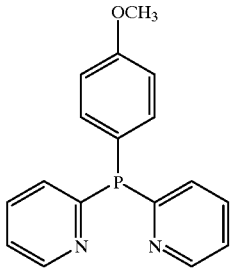
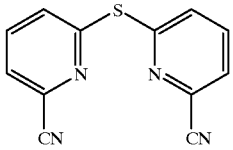
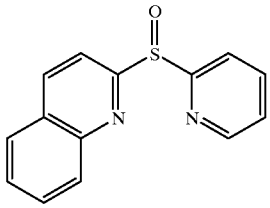
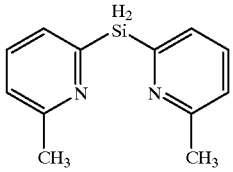
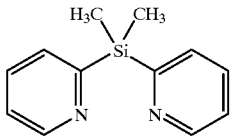

-continued
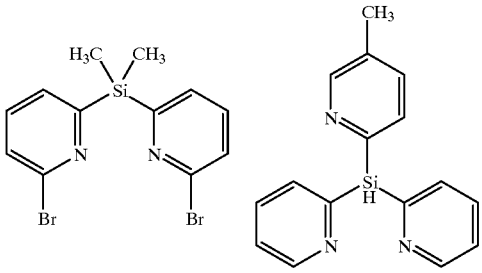
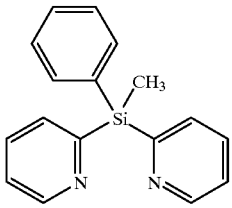
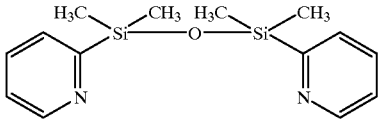
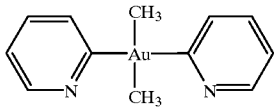
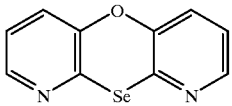
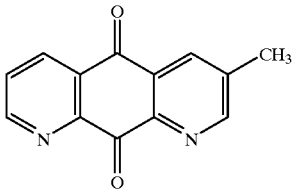
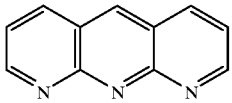
Y = $CN^-$, $NO_2^-$, $OH^-$, $F^-$, $Cl^-$, $Br^-$, $NH_3$, $H_2O$, CO, $H^-$, $CH_3CN$, $CH_3OH$
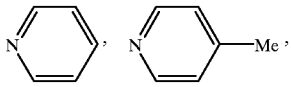
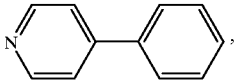
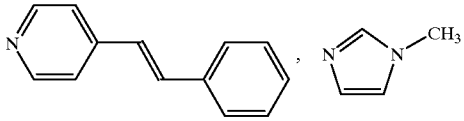
trimethyl phosphine, triethyl phosphine, methyl-diphenyl-phosphine,
L′ = 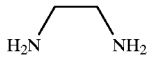 , 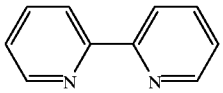
-continued
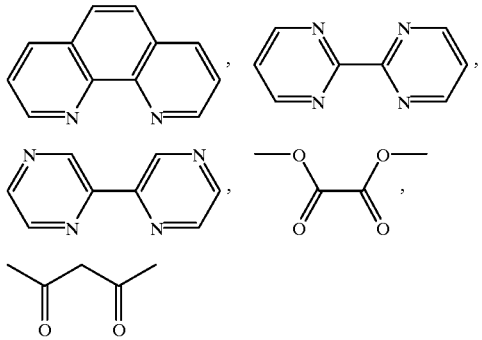
M = $Fe^{2+}$, $Ru^{2+}$, $Mn^{2-}$, $Co^{2+}$, $Co^{3+}$, $Rh^{3+}$, $Ir^{3+}$, $Ti^{3+}$, $Ti^{4+}$, $Os^{2+}$
The following compounds are metal complexes which can be preferably used as dopants in the invention.
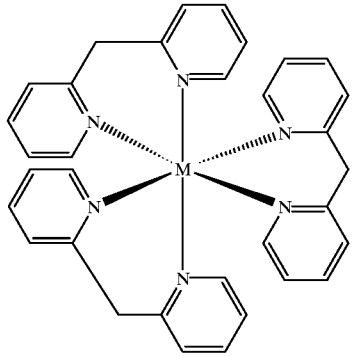
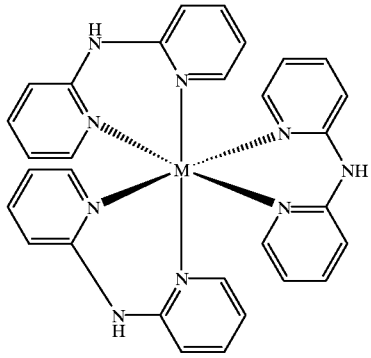
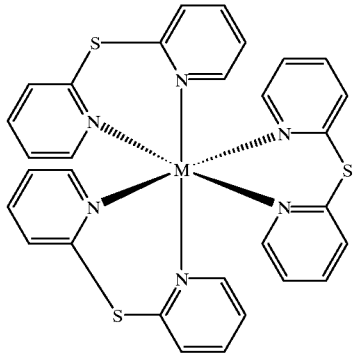

-continued
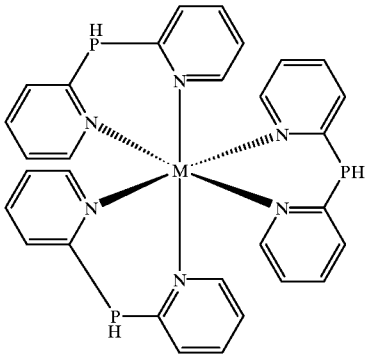
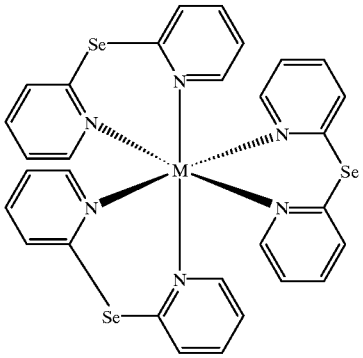
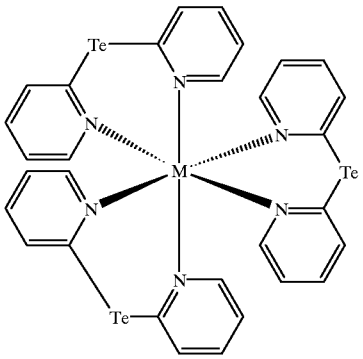
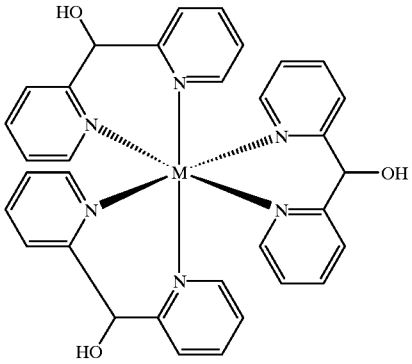
-continued
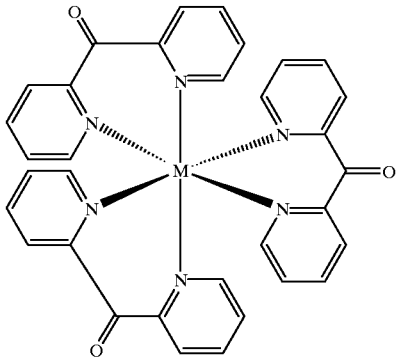
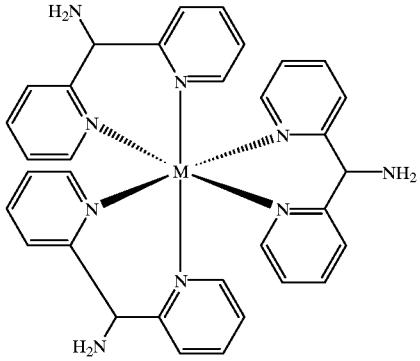
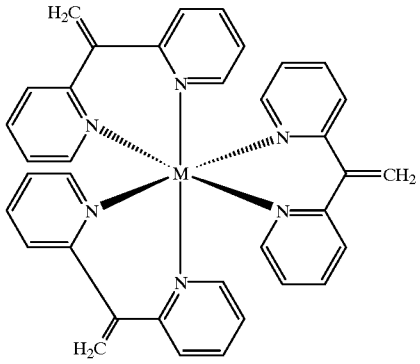
(M = $Fe^{2+}$, $Ru^{2+}$, $Co^{3+}$, $Ir^{3+}$)
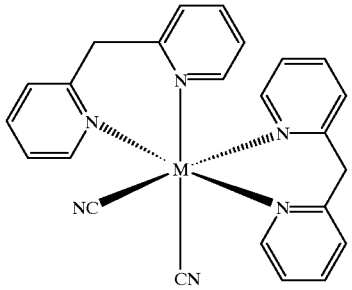
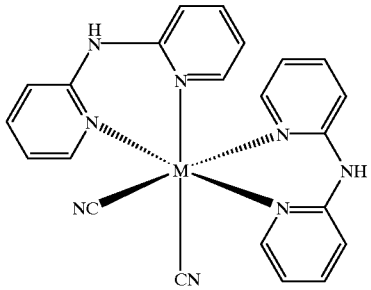

-continued

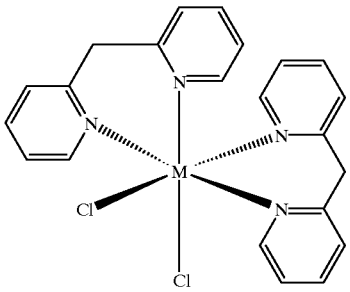

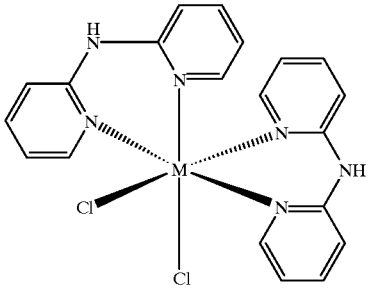

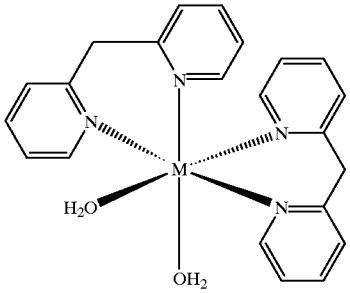

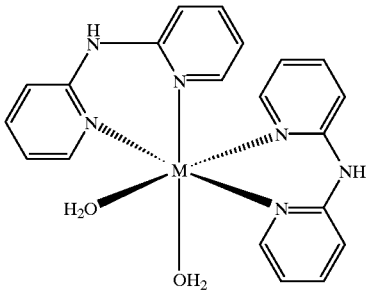

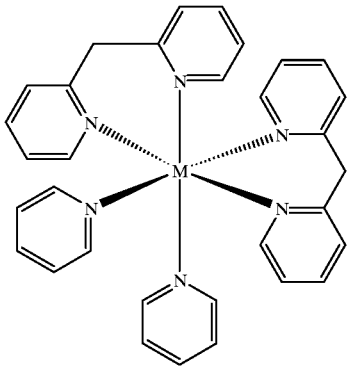

-continued

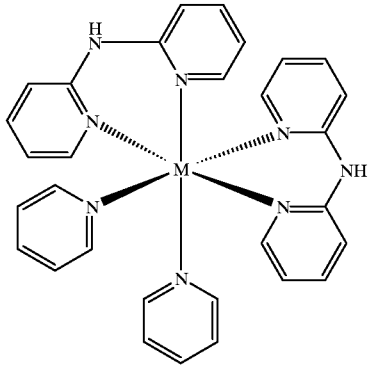

(M = $Fe^{2+}$, $Ru^{2+}$, $Co^{3+}$, $Ir^{3+}$)

The complexes used as dopants in the present invention are positive ions. As counter anions forming salts together with such complex cations, anions which are easily dissolved in water and fit in the precipitation step of silver halide emulsions are preferred. Examples of such anions include halide ions, nitrate ion, perchlorate ion, tetrafluoroborate ion, hexafluorophosphate ion, tetraphenylborate ion, hexafluoro-silicate ion and trifluoromethanesulfonate ion. Additionally, counter anions having high tendency toward coordination, such as cyanide, thiocyanide, nitrite and oxalate ions, are unsuitable. This is because it is likely that ligand exchange reaction occurs between those anions and ligands of the complexes of the present invention to make it difficult to retain the composition and the structure of the complexes. On the other hand, when the complex molecules of the present invention are converted into complex anions by removal of protons ($H^+$) from ligands therein, it is desirable that the complex anions be present together with counter cations. The counter cations preferably used are ions highly soluble in water and suitable for the precipitation step of silver halide emulsions, with examples including alkali metal ions, such as sodium, potassium, rubidium and cesium ions, ammonium ion and quaternary alkylammonium ions. Suitable examples of alkyl moieties of quaternary alkylammonium ions include methyl, ethyl, propyl, isopropyl and n-butyl groups. For these alkylammonium ions, it is advantageous in particular that all the four alkyl moieties are the same. More specifically, tetramethylammonium, tetraethylammonium, tetrapropylammonium and tetra(n-butyl)ammonium ions are preferred.

The complexes of the present invention can be synthesized using some methods. For instance, the synthesis methods of $[Ru(Hdpa)_3]^{2-}$ (Hdpa=di-2-pyridylamine) are described in Inorg. Chem., 1984, 23, 3010–2017. Well-organized general remarks concerning ruthenium complexes can be found in *Coord. Chem. Rev.,* 84 (1988) 85–277, and many Ru complexes can be synthesized consulting the references described therein.

In most of the hitherto known cases using as dopants the complexes formed with organic compound ligands, 5- or 6-membered hetrocyclic compounds have been employed as the ligands. The simplest replacement caused in the incorporation of metal complex ions into silver halide grains is a replacement made between six-coordinated octahedral complex ions (e.g., hexacyano or hexachloro complex ions) and $[AgX_6]^{-5}$ (X=halide ion) units in silver halide grains, as described in many references and patents, inclusive of *J. Phys.: Condens. Matter,* 9 (1997) 3227–3240. In the case where the ligands are molecules of a heterocyclic compound, the complex molecule is increased in a molecular size. It can therefore be presumed that it becomes sterically difficult to replace the complex molecules by $[AgX_6]^{5-}$ units alone. In order to solve such a steric problem, it is thought that a certain measure must be taken. For instance, as disclosed in JP-A-11-102042, adsorbing groups are introduced into ligands, and thereby the adsorption to the grain surface growing in the course of the grain formation is enhanced. As examples of ligands that are organic compounds other than 5- and 6-membered heterocyclic compounds, EDTE (ethylenediaminetetraacetic acid) and oxalic acid are exemplified. However, it is not clear from the hitherto disclosed patents whether or not the complexes containing those acids as ligands produce useful effects as dopants. Further, there is one reported case of making a highly sensitized emulsion by the use of a dopant containing DMSO (dimethyl sulfoxide) as a ligand. In this case, however, the dopant used in practice is $[Fe(CN)_5(DMSO)]^{3-}$, and this complex is merely used as a complex having properties not different from those of hexacyano complexes.

For increasing the sensitivity, it is thought that there is a necessity to introduce shallow electron traps arising from a Coulomb filed into silver halide grains by the use of a hexacyano complex as a dopent, as described in *Bulgarian Chem. Commun.,* 20(1993) 350–368, *Radiat. Eff. Defects Solids,* 135(1995) 101–104, and *J. Phys.: Condens. Matter,* 9(997) 3227–3240. A reason for such a necessity is explained below. The cyanide ions used as ligands can produce a strong ligand-field effect. More specifically, donation of electrons from a central metal to cyano ligands (back donation) forms π-bonds, and these π-bonds bring about further stabilization of the $t_{2g}$ orbital as the highest occupied level of the central metal, a reduction in metal-ligand distance and an increase in effective positive charge of the metal ion. As a result, a great split is caused in the d orbitals of the metal, and thereby the $e_g$ orbital (the lowest unoccupied molecular orbital) of the complex introduced as a dopant comes to have higher energy than the bottom of the conduction band of the silver halide grains, so the energy level thereof becomes unrelated to capture of photoelectrons. Only when such a state of energy levels are created, shallow electron traps arising from a Coulomb field can be introduced into silver halide grains. As described in *ICPS,* 1998, *Final Program and Proceedings,* Vol., 1, p. 89, *ICPS,* 1998, *Final Program and Proceedings,* Vol., 1, p. 92, and JP-A-8-286306, in a special case where the central atom used for such a complex is a divalent metal ion, such as $Fe^{2+}$ or $Ru^{2+}$, excess charge of +1 is brought into a grain environment constituted of $Ag^+$ and $Cl^-$ to form a Coulomb field and this field introduces photoelectron traps having an appropriate depth in silver chloride grains; as a result, the time lapsing before inactivation of photoelectrons generated by exposure is extended to increase the photographic speed to a considerable extent. When heterocyclic compounds are present as ligands in complexes, it is a common knowledge that they can produce a strong ligand-field effect comparable to that of cyanide ions, and it is supposed that the lowest unoccupied molecular orbital of such complexes can be put on an energy level higher than that of the bottom of the conduction band of silver halide as in the case of hexacyano complexes. In other words, it can be said that heterocyclic compounds are ligands required for bringing a great split in the ligand field, and compounds suitable as such ligands are heterocyclic compounds having large molecular sizes, such as 5- or 6-membered heterocyclic compounds. In addition, organic compounds having no heterocyclic structure have never been known to function as dopands capable of achieving a clear increase in sensitivity. From this fact also, the importance of ligand-field effect can be recognized.

However, as described above, the heterocyclic compounds providing those effects never act advantageously at the time when the complexes containing them as ligands are introduced into silver halide grains. In the case of containing organic compounds as ligands of complexes, the ligands that are thought to act favorably in introducing the complexes as dopants into silver halide grains are ligands having small molecular sizes or bearing negative charge themselves, and besides, forming complexes capable of producing the closest possible situation to that of $[AgX_6]^{5-}$ unit. When the compounds having small molecular sizes are contained as ligands in complexes, bidentate compounds are thought to be good for mentaining the stability of the complexes. Examples of a compound suitable as bidentate ligand include diamines such as ethylenedimaine, and diketones such as acetylacetone. Of these compounds, diketone compounds are preferred as the ligands of small-size dopants because their coordinate atoms are contained in double bonds or conjugated systems. In particular, β-diketones are most preferred. Further, acetylacetone and derivatives thereof (acetyl acetone compounds having substituent groups in their methyl moieties) are well known to form coordination bonds with metal ions to turn into ligands bearing negative charge, so that they meet small-size and negative-charge requirements and become especially favorable ligands.

The term "organic compound" used in the present invention means the compound whose parent compound is a chain or cyclic hydrocarbon. Additionally, part of the hydrogen and carbon atoms constituting the chain or cyclic hydrocarbon may be substituted with other atoms or atomic groups.

The diketone compounds preferably used in the present invention may contain any substituent groups. Examples of substituent groups which may be present therein include a hydrogen atom, a substituted or unsubstituted alkyl group (e.g., methyl, ethyl, n-propyl, isopropyl, n-butyl, t-butyl, hexyl, octyl, 2-ethylhexyl, dodecyl, hexadecyl, t-octtyl, isodecyl, isostearyl, dodecyloxypropyl, trifluoromethyl), an alkenyl group, an alkynyl group, an aralkyl group, a cycloalkyl group (e.g., cyclohexyl, 4-t-butylcyclohexyl), a substituted or unsubstituted aryl group (e.g., phenyl, p-tolyl, p-anisyl, p-chlorophenyl, 4-t-butylphenyl, 2,4-di-t-amylphenyl), a halogen atom (e.g., fluorine, chlorine, bromine, iodine), a cyano group, a mercapto group, a hydroxyl group, an alkoxy group (e.g., methoxy, butoxy, methoxyethoxy, dodecyloxy, 2-ethylhexyloxy), an aryloxy group (e.g., phenoxy, p-toyloxy, 4-t-butylphenoxy), an alkylthio group, an arylthio group, an acyloxy group, a sulfonyloxy group, a substituted or unsubstituted amino group (e.g., amino, methylamino, dimethylamino, anilino, N-methylanilino), and an acyl group (e.g., formyl, acetyl). In addition, adjacent substituent groups in each diketone compound may combine with each other to form a saturated carbon ring, an aromatic carbon ring or an aromatic hetero ring.

Examples of ligands preferred in the present invention are illustrated below. However, the ligands usable in the present invention should not be construed as being limited to these examples.

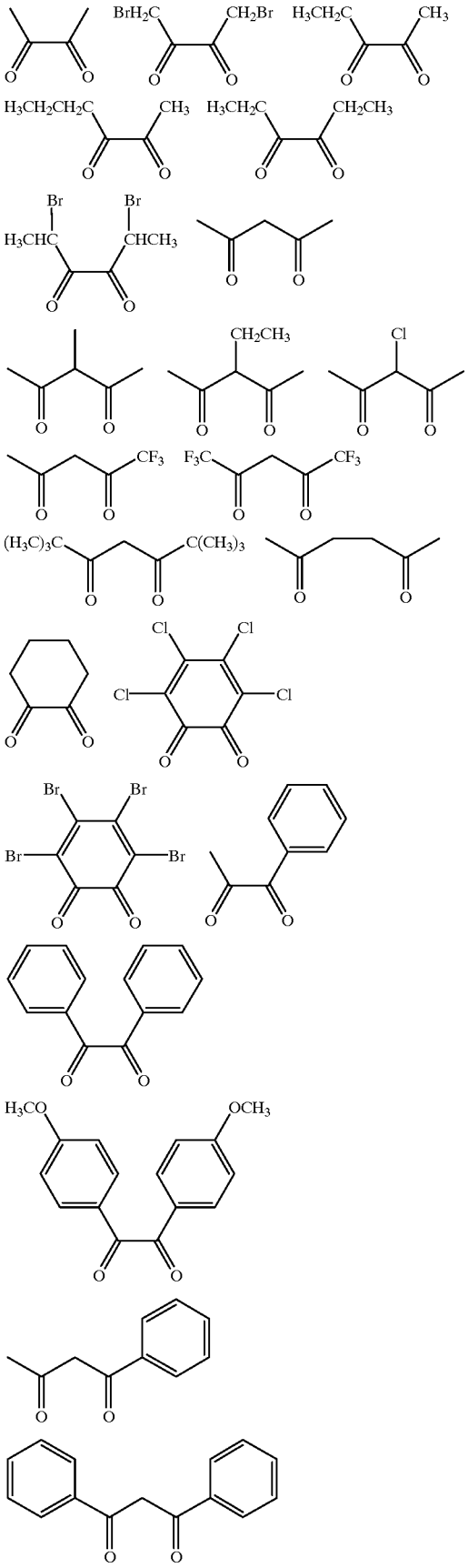

-continued

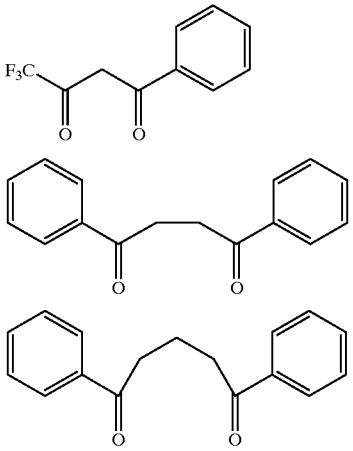

The complexes usable in the present invention has no particular limitations on their central metals. As described in many references and patents, including *J. Phys.: Condens. Matter,* 9 (1997) 3227–3240, when six-coordinated octahedral complexes are incorporated as dopants into silver halide grains, a part of $[AgX_6]^{5-}$ (X=halide ion) units constituting silver halide grains are considered to be replaced by the dopants. Therefore, the suitable coordinated configuration around the central metal is a four-coordinated or six-coordinated configuration. Further, it is advantageous that the central metal ions of the present invention can inactivate the replacement of ligands. According to the classification described in *Chem. Eng. New, April* 1, p. 68 (1968), the central metal ions suitable for the present invention are metal ions satisfying a requirement that the rate constants in the replacement of aquo ligands around the metal ions in aqueous solutions are smaller than $10^8$ $s^{-1}$, preferably smaller than $10^4$ $s^{-1}$, particularly preferably smaller than $10^{-3}$ $s^{-1}$. Suitable examples of the metal and ions thereof include alkaline earth metal, iron, ruthenium, manganese, cobalt, rhodium, iridium, vanadium, yttrium, lanthanum, cerium, praseodymium, europium, gadolinium, dysprosium, holmium, erbium, ytterbium, nickel, palladium, platinum, gold, zinc, titanium, chromium (exclusive of chromium(II)), osmium, cadmium, copper, aluminum and mercury and ions thereof. Of these metal ions, iron, ruthenium, manganese, cobalt, rhodium, iridium, titanium, chromium and osmium ions are preferred. In particular, iron, ruthenium, cobalt, rhodium and iridium ions are preferred.

Examples of the complexes of the present invention are illustrated below, but these examples should not be construed as limiting the scope of the present invention in any way.

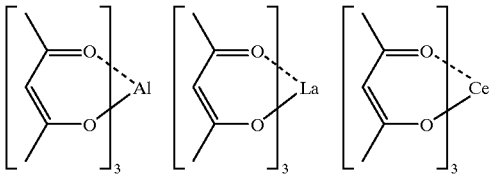

-continued

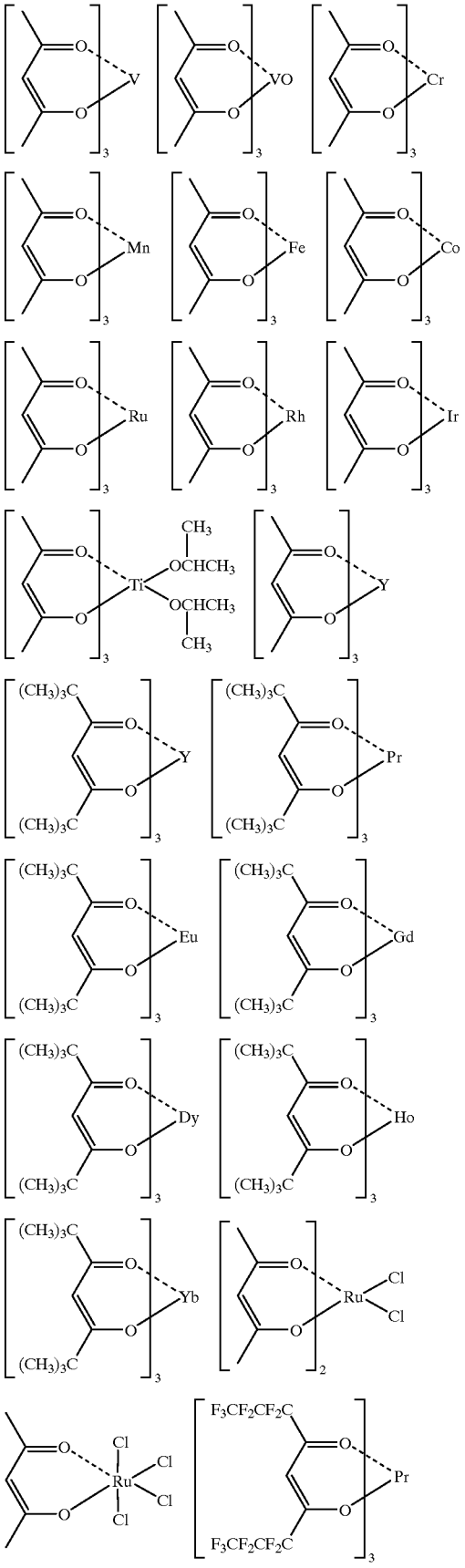

-continued

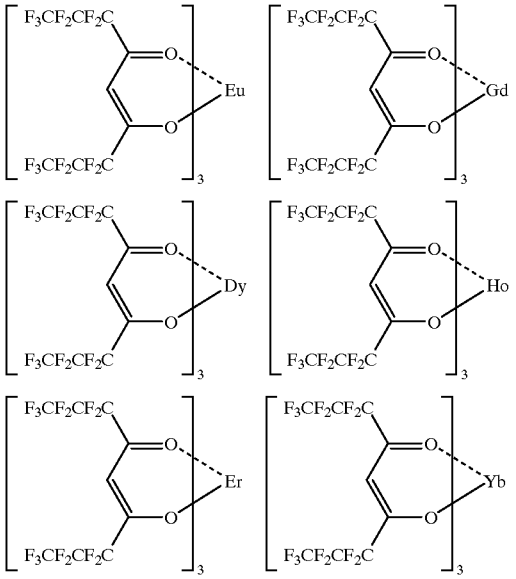

Although most of the complexes of the present invention used for doping bear no electric charge, only few of them are insoluble in water or alcohol. When the complexes, however, becomes anion and form salts together with cations, the cations as the counter ions are preferably ions highly soluble in water and suitable for the precipitation step of silver halide emulsions, with examples including alkali metal ions, such as sodium, potassium, rubidium and cesium ions, ammonium ion and quaternary alkylammonium ions. Suitable examples of alkyl moieties of quaternary alkylammonium ions include methyl, ethyl, propyl, iso-propyl and n-butyl groups. For these alkylammonium ions, it is advantageous in particular that all the four alkyl moieties are the same.

Each of the complexes of the present invention is preferably incorporated into silver halide grains by direct addition to a reaction solution at the step of forming silver halide grains, or by addition to a reaction solution for grain formation via the addition to an aqueous halide or another solution for forming silver halide grains. Also, the combination of these methods may be adopted for doping silver halide grains.

When silver halide grains are doped with a complex according to the present invention, the complex may be distributed uniformly inside the grains. In another way, as disclosed in JP-A-4-208936, JP-A-2-125245 and JP-A-3-188437, only the surface layer of the grains may be doped with the complex, or the complex may be introduced into only the inside of the grain, and besides, a dopant-free layer may be formed on the grain surface. In the present invention, however, it is preferable that the surface layer of the grains be doped. On the other hand, as disclosed in U.S. Pat. Nos. 5,252,451 and 5,256,530, the grains may be reformed in their surface phases through the physical ripening with doped fine grains. It is also a suitable manner that fine grains doped with a complex are prepared and added to an emulsion, and then the emulsion is subjected to physical ripening, thereby doping silver halide grains with the complex. In addition, the doping methods described above may be used in combination.

The suitable amount of a dopant used is from $1\times10^{-9}$ to $1\times10^{-2}$ mole, preferably from $1\times10^{-7}$ to $1\times10^{-3}$ mole, per mole of silver halide.

The silver halide emulsions used in the photographic materials of the present invention have no particular restriction as to the silver halide contained therein, so any of silver chloride, silver chlorobromide, silver bromide, silver iodochloride and silver iodobromide can be used therein. However, emulsions containing bromide ions or iodide ions are preferred as compared with a pure silver chloride emulsion. Although the silver halide emulsion grains used in the present invention have no particular restriction as to their sizes, it is suitable for them to have their equivalent sphere diameters in the range of 0.01 to 3 $\mu$m. The silver halide grains may have a regular (normal) crystal form or an irregular crystal form, but the grains having a normal crystal form are preferable. The normal crystal form includes the crystal forms of a cube, an octahedron, a dodecahedron, a tetradecahedron, an eicosahedron and an octatetracontahedron; while the irregular crystal form includes a spherical crystal form and a pebble-like crystal form. In addition, the silver halide grains to be doped with the complexes of the present invention may assume a crystal form having at least one twin plane. Specifically, grains of a tabular angular or tabular triangular form having two or three parallel twin planes are used to advantage. Further, it is preferable for the grains having such tabular forms to be monodisperse with respect to the grain size distribution. The preparation of monodisperse tabular grains is described in JP-A-63-11928. The description of monodisperse hexagonal tabular grains is found in JP-A-63-151618. The monodisperse emulsion comprising circular tabular grains is described in JP-A-1-131541. Further, JP-A-2-838 discloses the emulsion wherein at least 95%, based on projected area, of the total grains are tabular grains having two twin planes parallel to the main plane and the size distribution of these tabular grains is monodisperse. EP-A-0514742 discloses the tabular-grain emulsion prepared in the presence of a polyalkylene oxide block polymer and thereby achieving a variation coefficient of 10% or below with respect to the grain size distribution. By adopting these techniques, monodisperse emulsion grains suitable for the present invention can be prepared.

There are known tabular grains of two types, tabular grains whose main planes are (100) planes and tabular grains whose main planes are (111) planes. As to silver bromide, the tabular grains of the former type are disclosed in U.S. Pat. No. 4,063,951 and JP-A-5-281640. As to silver chloride, the tabular grains of the former type are disclosed in EP-A-0534395 and U.S. Pat. No. 5,264,337. The tabular grains of the latter type can have various shapes wherein at least one twin plane is present. As to the tabular grains of the latter type, the description of silver chloride can be found in U.S. Pat. Nos. 4,399,215, 4,983,508 and 5,183,732, JP-A-3-137632 and JP-A-3-116113. The dopants of the present invention can be used appropriately for both tabular grains having (100) main planes and those having (111) main planes.

The silver halide grains may have dislocation lines on the inside of the grains. The art of introducing dislocations into silver halide grains under control is disclosed in JP-A-63-220238. According to this document, the dislocation can be introduced by forming a particular phase having a high iodide content inside the tabular silver halide grains having an average grain diameter/grain thickness ratio of at least 2 and covering the outside with a phase lower in iodide content than the aforesaid phase having a high iodide content. The introduction of such a dislocation can produce various effects, including an increase in sensitivity, improvement in keeping quality, a rise in latent image stability and reduction in pressure fog. According to the present invention disclosed in the document described above, the dislocations are introduced mainly in the edge part of tabular grains. On the other hand, the tabular grains having dislocations introduced in the core part are disclosed in U.S. Pat. No. 5,238,796. Further, the grains having a regular crystal form and dislocations on the inside are disclosed in JP-A-4-348337. And this document discloses that the dislocations can be introduced by forming epitaxies of silver chloride or silver chlorobromide on the grains having a regular crystal form and subjecting the epitaxies to physical ripening and/or halogen conversion. Into the silver halide grains used in the present invention, dislocations can be introduced by the method of providing a phase high in iodide content or forming silver chlorobromide epitaxies, and by the introduction of dislocations in such a way, the effects of increasing sensitivity and decreasing pressure fog are obtained. The dislocation lines in silver halide grains can be observed by the direct method using a transmission electron microscope at a low temperature as described in, e.g., J. F. Hamilton, *Photo. Sci. Eng.,* vol. 11, p. 57 (1967) and T. Shinozawa, *J. Soc. Photo Sci. JAPAN,* vol. 35, p. 213 (1972). More specifically, the silver halide grains separated from an emulsion, taking care that they don't receive such pressure as to cause dislocation therein, are put on a mesh for observation with an electron microscope, and observed using a transmission method as they are cooled for protection against damage by electron beams (printout). Therein, the greater the grain thickness, the harder the transmission of electron beams, so that clear observation can be made by the use of high-voltage electron microscope (at least 200 kV to a grain thickness of 0.25 $\mu$m). From the electron micrographs of grains obtained by the aforementioned method can be determined the positions and the number of dislocation lines in each grain viewed from the plane perpendicular to the main plane. The present invention can achieve its effects when at least 50% of the total silver halide grains are grains in which at least 10 dislocation lines per grain are present.

The preparation of silver halide emulsions has no particular restrictions on additives used from the grain formation step till the coating step. For the purpose of promoting the crystal growth in the crystallization step or achieving effective chemical sensitization at the time of grain formation and/or chemical sensitization, silver halide solvents can be utilized. As appropriate silver halide solvents, it is possible to use water-soluble thiocyanates, ammonia, thioethers and thioureas. Suitable examples of a silver halide solvent include the thiocyanates disclosed in U.S. Pat. Nos. 2,222,264, 2,448,534 and 3,320,069, ammonia, the thioether compounds disclosed in U.S. Pat. Nos. 3,271,157, 3,574,628, 3,704,130, 4,297,439 and 4,276,347, the thione compounds disclosed in JP-A-53-144319, JP-A-53-82408 and JP-A-55-77737, the amine compounds disclosed in JP-A-54-100717, the thiourea derivatives disclosed in JP-A-55-2982, the imidazoles disclosed in JP-A-54-100717 and the substituted mercaptotetrazoles disclosed in JP-A-57-202531.

The silver halide emulsions used in the present invention have no particular restriction on their preparation methods. In general, aqueous silver salt and halide solutions are added to a reaction solution including an aqueous gelatin solution under efficient agitation. The methods usable therein are described in, e.g., P. Glafkides, *Chemie et Physique Photographique,* Paul Montel (1967), G. G. Dufin, *Photographic Emulsion Chemistry,* The Focal Press (1966), V. L. Zelikman, et al., *Making and Coating Photographic Emulsion,* The Focal Press (1964). More specifically, the emulsions prepared may be any of acid, neutral and ammoniacal emulsions, and the methods employed for reacting a water-soluble silver salt with a water-soluble halide may be any of a single jet method, a double jet method and a combination thereof. Further, the so-called controlled double jet method, wherein the pAg of the liquid phase in which silver halide grains to be precipitated is maintained constant, may be employed. In addition, it is also desirable that the emulsion grains be made to grow at the highest speed under the critical supersaturation limit by the use of the method of altering the addition speeds of aqueous silver nitrate and alkali halide solutions in proportion to the grain growth speed (as disclosed in U.K. Patent 1,535,016, JP-B-48-36890 and JP-B-52-16364) or the method of changing the concentrations of aqueous solutions (as described in U.S. Pat. No. 4,24,445 and JP-A-55-158124). These methods can be employed to advantage, because they cause no re-nucleation and ensure uniform growth of silver halide grains.

In another method which can be used to advantage, previously prepared fine grains are added to a reaction vessel instead of adding a silver salt solution and a halide solution to a reaction vessel, thereby causing nucleation and/or grain growth to prepare silver halide grains. The arts concerning this method are disclosed in JP-A-1-183644, JP-A-1-183645, JP-A-2-44335, JP-A-2-43534, JP-A-2-43535 and U.S. Pat. No. 4,879,208. According to this method, the halogen ion distribution inside the emulsion grains can be uniform throughout to provide desirable photographic characteristics. Furthermore, emulsion grains having various structures can be employed in the present invention. For instance, the grains constituted of the inner part (core part) and the outside thereof (shell part), or the grains having the so-called core/shell double-layered structure, the grains having a triple-layered structure (disclosed in JP-A-60-222844) and the grains having a multi-layer structure can be used. In a case where emulsion grains are formed so as to have an internal structure, the internal structure may be not only the wrapped-in structure as described above but also the so-called joined structure as disclosed in JP-A-58-108526, JP-A-59-16254, JP-A-59-133540, JP-B-58-24772 and EP-A2-0199290. Specifically, each host crystal joins crystallites differing therefrom in composition at its edge(s), corner(s) or face(s) and the crystallites are made to grow on the joined site(s) to form a crystal having a joined structure. In forming such crystals joined, the host crystal may have a uniform halide composition or a core/shell structure. In the case of forming a joined structure, though crystals of silver halide can be joined together as a matter of course, another silver salt compound having a structure other than the rock salt structure, such as silver thiocyanate or silver carbonate, may also be used so long as it can attain an epitaxial growth on silver halide crystals.

In the case of silver iodobromide grains having these structures, e.g., a core/shell structure, the iodide content may be high in the core part and low in the shell part, or vice versa. As for the silver iodobromide grains having a joined structure, the iodide content may be high in the host crystal and relatively low in the crystal joined to the host crystal, or vice versa. When the grains have those structures, each boundary between the parts differing in halide composition may have a clear interface, or may be rendered obscure by forming mixed crystals depending on the difference in halide composition. Also, a continuous change in structure may be positively introduced in the boundary region.

The silver halide emulsions used in the present invention may undergo the treatment for rounding the emulsion grains (as disclosed in EP-B1-0096727 or EP-B1-0064412) or modifying the grain surface (as disclosed in German Patent 2306447 C2 or JP-A-60-221320). And emulsions (i.e., surface latent image type emulsions) of the kind which form latent images predominantly at the surface of the grains are preferred in the present invention. However, as disclosed in JP-A-59-133542, it is also possible to use emulsions (i.e., internal latent image type emulsions) of the kind which mainly form latent images inside the grains so far as the developer or developing condition is chosen properly. Further, emulsions (i.e., shallow internal latent image type emulsions) of the kind which have the grain surface covered with a thin shell to form latent images in shallow part of the grains can be employed depending on the intended use.

In general, the silver halide emulsions are spectrally sensitized. Spectral sensitizing dyes usually employed therefor are methine dyes, including cyanine dyes, merocyanine dyes, complex cyanine dyes, complex merocyanine dyes, holopolarr cyanine dyes, hemicyanine dyes, styryl dyes and hemioxonol dyes. The basic heterocyclic rings constituting these dyes may be any rings usually present in cyanine dyes. As examples of such basic heterocyclic rings, pyrroline, oxazoline, thiazoline, pyrrole, oxazole, thiazole, selenazole, imidazole, tetrazole and pyridine rings are exemplified. In addition to these rings, rings formed by fusing together a hetero ring as described above and an alicyclic hydrocarbon ring and rings formed by fusing together a hetero ring as described above and an aromatic hydrocarbon ring are usable. Examples of such fused rings include indolenine, benzindolenine, indole, benzoxazole, naphthoxazole, benzothiazole, naphthothiazole, benzoselenazole, benzimidazole and quinoline rings. These rings each may have substituent groups on any of carbon atoms as the constituent atoms thereof. The merocyanine and complex merocyanine dyes can contain 5- or 6-membered heterocyclic rings having ketomethylene structure. Examples of such hetero rings include pyrazoline-5-one, thiohydantoin, 2-thioxazolidine-2,4-dione, thiazolidine-2,4-dione, rhodanine and thiobarbituric acid rings.

The suitable amount of sensitizing dyes added is from 0.001 to 100 millimole, preferably from 0.01 to 10 millimole, per mole of silver halide. It is desirable for the sensitizing dyes to be added during chemical sensitization or before chemical sensitization (e.g., at the time of grain formation or physical ripening).

In accordance with the present invention, the sensitivity to light of the wavelengths at which the chemically sensitized silver halide grains show their intrinsic absorption (namely the intrinsic sensitivity) is improved. More specifically, a decrease in the sensitivity to light of wavelengths longer than about 450 nm which is attributable to the adsorption of spectral sensitizing dyes to the surfaces of silver halide grains (namely the intrinsic desensitization due to sensitizing dyes) can be lessened by the doping with the complexes of the present invention. In other words, besides the effect of increasing the intrinsic sensitivity of silver halide, the present invention has a beneficial effect upon the prevention of the intrinsic desensitization due to sensitizing dyes.

To silver halide emulsions may be added dyes which, although they themselves do not spectrally sensitize silver halide emulsions, or materials which, although they do not absorb light in the visible region, can exhibit a supersensitizing effect in combination with a certain sensitizing dye. Examples of such dyes or materials include aminostilbene compounds substituted by nitrogen-containing heterocyclic groups (as disclosed in U.S. Pat. Nos. 2,933,390 and 3,635,721), aromatic organic acid-formaldehyde condensates (as disclosed in U.S. Pat. No. 3,743,510), cadmium salts and azaindene compounds. The combinations of spectral sensitizing dyes with the above-described dyes or materials are disclosed in U.S. Pat. Nos. 3,615,613, 3,615,641, 3,617,295 and 3,635,721.

In general the silver halide emulsions are used after undergoing chemical sensitization. For chemical sensitization, chalcogen sensitization (including sulfur sensitization, selenium sensitization and tellurium sensitization), noble metal sensitization (including gold sensitization) and reduction sensitization can be employed individually or as a combination of at least two thereof. The chemical sensitization preferably employed in the present invention is sulfur sensitization or the combination of sulfur sensitization and gold sensitization. In addition, selenium sensitization and tellurium sensitization are also favorably used. In sulfur sensitization, labile sulfur compounds are used as sensitizers. Examples of labile sulfur compounds are described in P. Glafkides, *Chimie et Physique Photographique,* 5th ed., Paul Montel (1987), *Research Disclosure* vol. 307, No. 307105, T. H. James, *The Theory of The Photographic Process,* 4th ed., Macmillan (1977), and H. Frieser, *Die Gründlagender Photographischen Prozess mit Silver-Halogeniden,* Akademische Verlagsgeselbshaft (1968). Suitable sulfur sensitizers which can be used include thiosulfates (such as sodium thiosulfate and p-toluenethiosulfonate), thioureas (such as diphenylthiourea, triethylthiourea, N-ethyl-N'-(4-methyl-2-thiazolyl)thiourea and carboxymethyltrimethylthiourea), thioamides (such as thioacetamide and N-phenylthioacetamide), rhodanines (such as rhodanine, N-ethylrhodanine, 5-benzylidenerhodanine, 5-benzylidene-N-ethylrhodanine and diethylrhodanine), phosphine sulfides (such as trimethylphosphine sulfide), thiohydantoins, 4-oxo-oxazolidine-2-thiones, dipolysulfides (such as dimorpholine disulfide, cystine and hexathiokane-thione), mercapto compounds (such as cysteine), polythionates and elemental sulfur. Also, active gelatins can be utilized as sulfur sensitizer.

In selenium sensitization, labile selenium compounds are used as sensitizers. Such labile selenium compounds are disclosed in JP-A-43-13489, JP-A-44-15748, JP-A-4-25832, JP-A-4-109240, JP-4-271341 and JP-A-5-40324. Examples of suitable selenium sensitizers which can be used include colloidal metallic selenium, selenoureas (such as N,N-dimethylselenourea, trifluoromethylcarbonyl-trimethylselenourea and acecyl-trimethylselenourea), selenoamides (such as selenoacetamide and N,N-diethylphenylselenoamide), phosphine selenides (such as triphenylphosphine selenide and pentafluorophenyl-triphenylphosphine selenide), selenophosphates (such as tri-p-tolylselenophosphate and tri-n-butylselenophosphate), selenoketones (such as selenobenzophenone), isoselenocyanates, selenocarboxylic acids, selenoesters and diacylselenides. In addition, moderately stable selenium compounds (as disclosed in JP-B-46-4553 and JP-B-52-34492), including selenious acid, potassium selenocyanate, selenazoles and selenides, can also be utilized as selenium sensitizers.

In tellurium sensitization, labile tellurium compounds are used as sensitizers. Such labile tellurium compounds are disclosed in Canadian Patent 800,958, U.K. Patents 1,295,462 and 1,396,696, JP-A-4-204640, JP-A-4-271341, JP-A-4-333043 and JP-A-5-303157. Examples of suitable tellurium sensitizers which can be used include telluroureas (such as tetramethyltellurourea, N,N'-dimethylethylenetellurourea and N,N'-diphenylethylenetellurourea), phosphine tellurides (such as butyldiisopropylphosphine telluride, tributylphosphine telluride, tributoxyphosphine telluride and ethoxydiphenylphosphine telluride), diacyl(di)tellurides (such as bis(diphenylcarbamoyl) ditelluride, bis(N-phenyl-N-methylcarbamoyl) ditelluride, bis(N-phenyl-N-methylcarbamoyl) telluride and bis(ethoxycarbonyl) telluride), isotellurocyanates (such as allylisotellurocyanate), telluroketones (such as telluroacetone and telluroacetophenone), telluroamides (such as telluroacetamide and N,N-dimethyltellurobenzamide), telluro-hydrazides (such as N,N',N'-trimethyltellurobenzohydrazide), telluroesters (such as t-butyl-t-hexyltelluroester), colloidal tellurium, (di) tellurides and other tellurium compounds (such as potassium telluride and sodium telluropentathionate).

In noble metal sensitization, the salts of noble metals, such as gold, platinum, palladium and iridium, are used as sensitizers. Such noble metal salts are described in, e.g., P. Glafkides, *Chimie et Physique Photographique,* 5th ed., Paul Montel (1987), and *Research Disclosure,* vol. 307, No. 307105. In particular, gold sensitization is preferred. Examples of gold compounds suitable for gold sensitization include chloroauric acid, potassium chloroaurate, potassium aurithiocyanate, gold sulfide and gold selenide. In addition, the gold compounds disclosed in U.S. Pat. Nos. 2,642,361, 5,049,484 and 5,049,485 can be used as gold sensitizers.

In reduction sensitization, reducing compounds are used as sensitizers. Such reducing compounds are described in, e.g., P. Glafkides, *Chimie et Physuque Photographique,* 5th ed., Paul Montel (1987), and *Research Disclosure,* vol. 307, No. 307105. Examples of suitable reduction sensitizers which can be used include aminoiminomethanesulfinic acid (thiourea dioxide), borane compounds (such as dimethylamine borane), hydrazine compounds (such as hydrazine and p-tolylhydrazine), polyamine compounds (such as diethylenetriamine and triethylenetetramine), stannous chloride, silane compounds, reductones (such as ascorbic acid), sulfites, aldehyde compounds and hydrogen. In addition, reduction sensitization can be carried out in an atmosphere of high pH or excess silver ions (the so-called silver ripening).

Two or more kinds of chemical sensitization may be carried out in combination. In particular, the combination of chalcogen sensitization and gold sensitization is preferred Further, it is effective that the reduction sensitization be carried out in the step of forming silver halide grains. The amount of each sensitizer used is generally determined depending on what type of silver halide grains are sensitized and what condition is adopted for the chemical sensitization. Specifically, the amount of a chalcogen sensitizer used is generally from $10^{-8}$ to $10^{-2}$ mole, preferably from $10^{-7}$ to $5\times10^{-3}$ mole, per mole of silver halide. The amount of a noble metal sensitizer used is preferably from $10^{-7}$ to $10^{-2}$ mole per mole of silver halide. As to the conditions for chemical sensitization, there are no particular restrictions. However, it is appropriate for chemical sensitization that the pAg be from 6 to 11, preferably from 7 to 10, the pH be from 4 to 8, and the temperature be from 40 to 95° C., preferably 45 to 85° C.

The silver halide emulsions used in the present invention can contain a wide variety of compounds for purposes of preventing fogging or stabilizing photographic properties during production, storage or photographic processing of the photographic material in the present invention. Examples of compounds usable for the foregoing purposes include azoles (such as benzothiazolium salts, nitroindazoles, triazoles, benzotri-azoles and benzimidazoles (especially those substituted with nitro groups or halogen atoms)), heterocyclic mercapto compounds (such as mercaptothiazoles, mercaptobenzothiazoles, mercaptobenzimidazoles, mercaptothiadiazoles, mercapto-tetrazoles (especially 1-phenyl-5-mercaptotetrazole) and mercaptopyrimidines), the above-described heterocyclic mercapto compounds further containing a water-soluble group such as a carboxyl or sulfo group, thioketo compounds (such as oxazolinethione) azaindenes (such as tetraazaindenes (especially 1,3,3a,7-tetraazaindenes substituted with a hydroxyl group at the 4-position), benzenethiosulfonic acids and benzenesulfinic acid. In general these compounds are known as antifoggants or stabilizers.

The appropriate time for addition of such an antifoggant or stabilizer is generally after chemical sensitization. However, the time for addition may be chosen from any stages during or before chemical sensitization. Specifically, the antifoggants or stabilizers may be added during the addition of a silver salt solution in the process of forming silver halide emulsion grains, or during the period from the conclusion of addition of a silver salt solution to the beginning of chemical sensitization, or during chemical sensitization (preferably during the first half of chemical sensitization, more preferably during the period from the beginning of chemical sensitization to the time corresponding to one fifth of chemical sensitization time).

The present silver halide photographic materials have no particular restrictions as to their layer structures. When they are color photographic materials, however, they have a multi-layer structure for recording blue light, green light and red light separately. Further, each silver halide emulsion layer may be constituted of two layers, or a high speed layer and a low speed layer. Examples of a practical layer structure are given by items (1) to (6) below:

(1) BH/BL/GH/GL/RH/RL/S (2) BH/BM/BL/GH/GM/GL/RH/RM/RL/S (3) BH/BL/GH/RH/GL/RL/S (4) BH/GH/RH/BL/GL/RL/S (5) BH/BL/CL/GH/GL/RH/RL/S (6) BH/BL/GH/GL/CL/RH/RL/S

Therein, B means a blue-sensitive layer, G for a green-sensitive layer, R for a red-sensitive layer, H for a highest speed layer, M for a medium speed layer, L for a low speed layer, S for a support, and CL for an interlayer effect-providing layer. Light-insensitive layers, such as a protective layer, a filter layer, an interlayer, an anti-halation layer and a subbing layer, are omitted from the foregoing representation of layer structures. In addition, the arranging order of high speed and low speed layers having the same color sensitivity may be reversed. The layer structure (3) is described in U.S. Pat. No. 4,184,876. The layer structure (4) is described in *Research Disclosure,* vol. 225, No. 22534, JP-A-59-177551 and JP-A-59-177552. The layer structures (5) and (6) are described in JP-A-61-34541. The layer structures (1), (2) and (4) are preferred among these layer structures. Besides color photographic materials, the silver halide photographic materials of the present invention can be applied to X-ray photographic materials, sensitive materials for black and white photography, sensitive materials for plate-making and photographic printing paper.

As to the various additives usable in the silver halide emulsions of the present invention (e.g., binders, chemical sensitizers, spectral sensitizers, stabilizers, gelatin, hardeners, surfactancts, antistatic agents, polymer latexes, matting agents, color couplers, ultraviolet absorbents, discoloration inhibitors, dyes), supports for photographic materials and processing methods for photographic materials (e.g., coating methods, exposure methods, development-processing methods), the descriptions in *Research Disclosure,* vol. 176, No. 17643 (abbreviated as "RD-17643"), vol. 187, No. 18716 (abbreviated as "RD-18716") and vol. 225, No. 22534 (abbreviated as "RD-22534") can be referred to. The locations where the additives are described in each of those references are listed below.

| Kinds of Additives | RD-17643 | RD-18716 | RD-22534 |
|---|---|---|---|
| 1. Chemical sensitizer | p. 23 | p. 648, right column | p. 24 |
| 2. Sensitivity increasing agent | | p. 648, right column | |
| 3. Spectral sensitizer and Supersensitizer | pp. 23–24 | p. 648, right column, to p. 649, right column | pp. 24–28 |
| 4. Brightening agent | p. 24 | | |
| 5. Antifoggant and Stabilizer | pp. 24–25 | p. 649, right column | p. 24 and p. 31 |
| 6. Light absorbent, Filter dye, UV absorbent | pp. 25–26 | p. 649, right column, to p. 650, left column | |
| 7. Stain inhibitor | p. 25, right column | p. 650, left to right column | |
| 8. Dye image stabilizer | p. 25 | | p. 32 |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating aid, Surfactant | pp. 26–27 | p. 650, right column | |
| 13. Antistatic agent | p. 27 | p. 650, right column | |
| 14. Color coupler | p. 25 | p. 649 | p. 31 |

With respect to the gelatin hardeners, for example, active halogen compounds (such as 2,4-dichloro-6-hydroxy-1,3,5-triazine and sodium salt thereof) and active vinyl compounds (such as 1,3-bisvinylsulfonyl-2-propanol, 1,2-bis (vinylsulfonylacetamido)ethane and vinyl polymers having vinylsulfonyl groups in their chains) are used to advantage because they can quickly harden hydrophilic colloids such as gelatin to provide stable photographic characteristics. In addition, N-carbamoylpyridinium salts (such as (1-morpholinocarbonyl-3-pyridinio)methanesulfonate) and haloamidinium salts (such as 1-(1-chloro-1-pyridinomethylene) pyrrolidinium 2-naphthalenesulfonate) are also excellent hardeners because of their high hardening speed.

The color photographic materials can be processed using the general methods described in *Research Disclosure,* vol. 176, No. 17643 and ibid., vol. 187, No. 18716. Specifically, the color photographic materials are subjected sequentially to development processing, bleach-fix or fixation processing, and washing or stabilization processing. In the washing step, a counter-current washing method using two or more tanks is generally adopted to effect a water saving. As a typical example of stabilization processing which can take the place of washing processing, the multistage counter-current stabilization processing as disclosed in JP-A-57-8543 can be described.

The present invention will now be illustrated in greater detail by reference to the following examples, but it should be understood that these examples are not to be construed as limiting the scope of the present invention in any way.

EXAMPLE I-1

Emulsion 1-1: Preparation of Octahedral Silver Bromide Emulsion Sample

To 870 ml of water were added 36 g of demineralized gelatin and 0.25 g of potassium bromide to prepare a solution. To this aqueous solution of gelatin kept at 75° C. with stirring, 36 ml of a 0.083 M aqueous solution of silver nitrate (Solution 1) and 36 ml of a 0.087 M aqueous solution of potassium bromide (Solution 2) were added at a constant flow rate over a 10-minute period in accordance with a double jet method. Subsequently thereto, 176 ml of Solution 1 and 176 ml of Solution 2 were added over a 7-minute period using the double jet method. Thereafter, 675 ml of a 0.82 M aqueous solution of silver nitrate (Solution 3) was further added over a 60-minute period at an accelerated flow rate, beginning with the flow rate of 1.8 ml/min. Simultaneously therewith, a 0.83 M aqueous solution of potassium bromide (Solution 4) was added while controlling so that the pBr was kept at 2.93. Subsequently thereto, 223 ml of Solution 3 was further added over a 25-minute period at a constant flow rate, and at the same time an aqueous potassium bromide solution (Solution 5) having the same concentration as Solution 4 was added while controlling so that the pBr was kept at 2.93. After the 5 minute-lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and 2-phenoxyethanol, and adjusted to pH 6.5. The emulsion grains formed in the foregoing manner were monodisperse silver bromide octahedrons having an edge length of 0.7 $\mu$m.

Emulsion 1-2: $[Fe(CN)_6]^{4-}$-doped Octahedral Silver Bromide Emulsion

Comparative Example

Emulsion 1-2 was prepared in the same manner as Emulsion 1-1, except that $[Fe(CN)_6]^{4-}$ was added to Solution 5 in an amount of $2.5\times10^{-4}$ mole per mole of silver added at this step. (The amount of silver added at this step corresponded to 25% of the total amount of silver added for preparation of the emulsion. The dopant added was introduced into a surface layer of each grain, i.e., the dopant was introduced into the outer 75 to 100% of each grain volume.)

Emulsion 1-3: $[Ru(bpy)_2Cl_2]^0$-doped Octahedral Silver Bromide Emulsion

Comparative Example

Emulsion 1-3 was prepared in the same manner as Emulsion 1-1, except that $[Ru(bpy)_2Cl_2]^0$ (bpy=2,2'-bipyridine) dissolved in a 0.21 M aqueous KBr solution was added simultaneously with not only Solution 3 but also Solution 4, followed by Solution 5, in accordance with a triple jet method. Therein, the addition of the complex solution was finished after a lapse of 15 minutes from the beginning of the addition of Solution 5, and the $[Ru(bpy)_2Cl_2]^0$ concentration was determined so that the ratio of $[Ru(bpy)_2Cl_2]^0$ to the silver added at this triple jet step was $1\times10^{-4}$:1 by mole.

Emulsions 1-4 to 1-8: Octahedral Silver Bromide Emulsions Doped with Present Complexes Present Invention Emulsions 1-4 to 1-8 were prepared in the same manner as Emulsion 1-1, except that the complexes of the present invention, $[Ru(CN)_4(Hdpa)]^-$ (Hdpa=di-2-pyridylamine), $[Ru(Hdpa)_3]^{2+}$, $[Ru(dpm)_3]^{2+}$ (dpm=di-2-pyridylmethane), $[Ru(bpy)_2(Hdpa)]^{2+}$ and $[Ru(bpy)_2(dpm)]^{2+}$ were dissolved in separate portions of a 0.21 M aqueous KBr solution, respectively, and each of these solutions was added simultaneously with not only Solution 3 but also Solution 4, followed by Solution 5, in accordance with a triple jet method. Therein, the addition of each complex solution was finished after a lapse of 15 minutes from the beginning of the addition of Solution 5, and the concentration of each complex was determined so that the ratio of each complex to the silver added at this triple jet step was $1\times10^{-4}$:1 by mole.

Each of the silver bromide Emulsions 1-1 to 1-8 was admixed with $8.0\times10^{-6}$ mole/mole Ag of sodium thiosulfate, $9.6\times10^{-6}$ mole/mole Ag of chloroauric acid and $3.4\times10^{-4}$ mole/mole Ag of potassium thiocyanate, and underwent optimal chemical sensitization at 60° C. Each of the thus chemically sensitized Emulsions 1-1 to 1-8 was spectrally sensitized with $4.9\times10^{-4}$ mole/mole Ag of Sensitizing Dye (1). After gelatin and sodium dodecylbenzenesulfonate were added thereto, each of these chemically and spectrally sensitized emulsions was coated at a silver coverage of 2 g/m$^2$ on a subbing layer-provided triacetyl cellulose film support by the use of an extrusion method, together with a protective layer containing gelatin, polymethylmethacrylate particles and sodium salt of 2,4-dichloro-6-hydroxy-s-triazine. Thus, coated Samples 1-1 to 1-8 were prepared.

Sensitizing Dye (1)

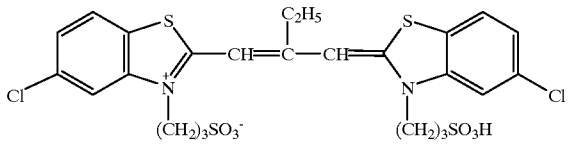

These Samples were each subjected to the exposure for sensitometry (1 second) via an optical wedge, and then developed for 10 minutes at 20° C. with Developer 1 prepared according to the formula described below. Thereafter, each sample underwent sequentially usual stop, fixation, washing and drying operations, and then examined for optical density. The fog density was determined as the minimum optical density of each sample, and the sensitivity was represented by the reciprocal of an exposure amount required for providing the optical density of (fog+0.1). The sensitivities of Samples are shown as relative values, with the dopant-free Sample being taken as 100. In Table I-1, there are shown relative sensitivities determined when the Samples 1-1 to 1-8 were each exposed to light of wavelengths at which the spectral sensitizing dye had absorption.

| Developer 1 | |
|---|---|
| Metol | 2.5 g |
| L-Ascorbic acid | 10.0 g |
| Nabox | 35.0 g |
| KBr | 1.0 g |
| Water to make | 1 liter |
| pH adjusted to | 9.6 |

TABLE I-1

| Sample No. | Emulsion No. | Dopant[a] | Relative sensitivity*1 |
|---|---|---|---|
| 1-1 (comparison) | 1-1 | not added | 100 |
| 1-2 (comparison) | 1-2 | $[Fe(CN)_6]^{4-}$ | 118 |
| 1-3 (comparison) | 1-3 | $[Ru(bpy)_2Cl_2]^0$ | 117 |
| 1-4 (invention) | 1-4 | $[Ru(CN)_4(Hdpa)]^-$ | 120 |
| 1-5 (invention) | 1-5 | $[Ru(Hdpa)_3]^{2+}$ | 141 |
| 1-6 (invention) | 1-6 | $[Ru(dpm)_3]^{2+}$ | 128 |
| 1-7 (invention) | 1-7 | $[Ru(bpy)_2(Hdpa)]^{2+}$ | 125 |
| 1-8 (invention) | 1-8 | $[Ru(bpy)_2(dpm)]^{2+}$ | 120 |

[a]Symbols of ligands in each dopant, bpy, Hdpa and dmp, mean 2,2'-bipyridine, di-2-pyridylamine and di-2-pyridyl-methane, respectively.
*1Relative value under the condition given to each Sample, with Sample 1-1 being taken as 100.

In Table I-1 are set forth sensitivities of the emulsions doped with the complexes of the present invention, respectively. Therein, the layer comprising 90% of each silver bromide grain on a volume basis was doped with those complexes each. The emulsions doped with the complexes of the present invention having at least one Hdpa or dpm ligand were all higher in sensitivity. Of the complexes according to the present invention, sensitivity increasing effect was great in particular when all the ligands contained in each dopant were the same. The sensitivities achieved by the use of these dopants exceeded those achieved by the use of $[Fe(CN)_6]^{4-}$ which has often used as a sensitivity-increasing dopant and $[Ru(bpy)_2Cl_2]^0$ disclosed in JP-A-5-341426.

EXAMPLE I-2

Emulsion 2-1: Preparation of Emulsion Comprising Tabular Silver Iodobromide Grains having (111) Faces as Main Planes One liter of a dispersing medium solution (pH=5) containing 0.38 g of KBr and 0.5 g of low molecular weight gelatin (molecular weight: 15,000) was kept at 40° C. To this solution with stirring, 20 ml of a 0.29 M silver nitrate solution and 20 ml of a 0.29 M KBr solution were added over a 40-second period in accordance with a double jet method. After the addition, 15 minutes were spent in heating this dispersing medium solution up to 75° C. After a 15-minute lapse from such a heating operation, a dispersing medium solution containing 35 g of alkali-processed gelatin and 250 ml of water was further added. After adjusting the pH to 6.0, 734 ml of a 1.2 M silver nitrate solution was added at an accelerated flow rate. During this addition operation, a mixture of KBr and KI solutions was also added so that the pBr was kept at 2.93. Therein, the KI solution and the KBr solution were admixed in such amounts that the $I^-$ concentration was 3 mole % to the amount of silver added.

Emulsions 2-2 and 2-3: Emulsions comprising Tabular Silver Iodobromide Grains doped with $[Ru(CN)_6]^{4-}$ and $[Ru(bpy)_2Cl_2]^0$ Respectively Comparative Examples Emulsions 2-2 and 2-3 were prepared by adding to Emulsion 2-1 the dopants $[Ru(CN)_6]^{4-}$ and $[Ru(bpy)_2Cl_2]^0$ in amounts of $1\times10^{-4}$ mole and $2.5\times10^{-4}$ mole, respectively per mole of silver contained in the emulsion grains as a whole so that those complexes were each introduced into a part corresponding to 80 to 100% of each grain on a volume basis.

Emulsions 2-4 and 2-5: Emulsions comprising Tabular Silver Iodobromide Grains doped with $[Ru(Hdpa)_3]^{2+}$ and $[Ru(dpm)_3]^{2+}$ Respectively Present Invention Emulsions 2-4 and 2-5 were prepared by adding to Emulsion 2-1 the complexes of the present invention, $[Ru(Hdpa)_3]^{2+}$ and $[Ru(dpm)_3]^{2+}$ in amounts of $5\times10^{-5}$ mole and $2\times10^{-5}$ mole, respectively per mole of silver contained in the emulsion grains as a whole so that those complexes were each introduced into a part corresponding to 80 to 100% of each grain on a volume basis.

Each of the Emulsions 2-1 to 2-5 was admixed with $8.0\times10^{-6}$ mole/mole Ag of sodium thiosulfate, $3\times10^{-6}$ mole/mole Ag of chloroauric acid and $3\times10^{-6}$ mole/mole Ag of potassium thiocyanate, and underwent optimal chemical sensitization at 60° C. Each of these chemically sensitized emulsions was coated in the same manner as in Example I-1, thereby preparing coated Samples 2-1 to 2-5.

These Samples were each subjected to the exposure for sensitometry ($10^{-2}$ second) via an optical wedge, and then developed by the same method as in Example I-1. Thereafter, each sample was subjected sequentially to usual stop, fixation, washing and drying operations, and then examined for optical density. The sensitivities of the coated Samples (spectral sensitizing dye-free samples) set forth in Table I-2 are relative sensitivities determined when the samples were each exposed to light of wavelengths at which the silver halide therein showed the intrinsic absorption.

TABLE I-2

| Sample No. | Emulsion No. | Dopant[a] | Amount added (mol/mol Ag) | Relative sensitivity *1($10^{-2}$ sec exposure |
|---|---|---|---|---|
| 2-1 (comparison) | 2-1 | not added | — | 100 |
| 2-2 (comparison) | 2-2 | $[Ru(CN)_6]^{4-}$ | $1\times10^{-4}$ | 105 |
| 2-3 (comparison) | 2-3 | $[Ru(bpy)_2Cl_2]^0$ | $2.5\times10^{-4}$ | 106 |
| 2-4 (invention) | 2-4 | $[Ru(Hdpa)_3]^{2+}$ | $5\times10^{-5}$ | 118 |
| 2-5 (invention) | 2-5 | $[Ru(dpm)_3]^{2+}$ | $2\times10^{-5}$ | 125 |

[a]Symbols of ligands in each dopant, bpy, Hdpa and dmp, mean 2,2'-bipyridine, di-2-pyridylamine and di-2-pyridyl-methane respectively.
*1Relative values, with Sample 2-1 being taken as 100.

The complexes $[Ru(Hdpa)_3]^{2+}$ and $[Ru(dpm)_3]^{2+}$, whose great sensitivity-increasing effect upon octahedral silver bromide emulsions are demonstrated in Table I-1, were also used for doping a tabular grain emulsion. As a result, it has been proved that the tabular grain emulsions also had greatly increased sensitivities when doped with those complexes, compared with the case where they were doped with the complex $[Ru(CN)_6]^{4-}$ or $[Ru(bpy)_2Cl_2]^0$ hitherto known to cause a considerable increase in sensitivity. The sensitivity-increasing effect caused in the tabular grain emulsion doped with $[Ru(dpm)_3]^{2-}$ was especially great despite the smaller amount of complex added. By doping emulsions with the complexes of the present invention, sensitivities of the emulsions were greatly increased, and besides, the sensitivity difference between the doped emulsions and the dopant-free emulsion or the $[Ru(CN)_6]^{4-}$-doped emulsion became greater in the high optical density area, and so the doped emulsions of the present invention were found to be higher in contrast also. Further, the maximum densities of the emulsions doped with the complexes of the present invention were higher than those of the dopant-free emulsion and the $[Ru(CN)_6]^{4-}$-doped emulsion.

EXAMPLE I-3

Emulsion 3: Tabular Silver Iodobromide Emulsion Doped with Present Complex $[Ru(dpm)_3]^{2+}$ Emulsion 2-5 prepared in Example I-2 was subjected to optimal chemical sensitization, further to spectral sensitization, and then used as the emulsion for the third layer of the sensitive material Sample 201 in Example 2 of JP-A-9-146237. The thus prepared sensitive material was subjected to the same photographic processing as in the example of the reference described above, and produced satisfactory results.

EXAMPLE I-4

Emulsion 4: Tabular Silver Iodobromide Emulsion Doped with Present Complex $[Ru(dpm)_3]^{2+}$ Emulsion 2-5 prepared in Example I-2 was subjected to optimal chemical sensitization, further to spectral sensitization, and then used as the emulsion for the third layer of the sensitive material Sample 110 in Example 1 of JP-A-10-20462. The thus prepared sensitive material was subjected to the same photographic processing as in the example of the reference described above, and produced satisfactory results.

EXAMPLE II-1

Emulsion 1-1: Preparation of Octahedral Silver Bromide Emulsion Sample

To 870 ml of water were added 36 g of demineralized gelatin and 0.25 g of potassium bromide to prepare a solution. To this aqueous gelatin solution kept at 75° C. with stirring, 36 ml of a 0.083 M aqueous solution of silver nitrate (Solution 1) and 36 ml of a 0.087 M aqueous solution of potassium bromide (Solution 2) were added at a constant flow rate over a 10-minute period in accordance with a double jet method. Subsequently thereto, 176 ml of Solution 1 and 176 ml of Solution 2 were added over a 7-minute period using the double jet method. Thereafter, 675 ml of a 0.82 M aqueous solution of silver nitrate (Solution 3) was further added over a 60-minute period at an accelerated flow rate, beginning with the flow rate of 1.8 ml/min. Simultaneously therewith, a 0.83 M aqueous solution of potassium bromide (Solution 4) was added while controlling so that the pBr was kept at 2.93. Subsequently thereto, 223 ml of Solution 3 was further added over a 25-minute period at a constant flow rate, and at the same time an aqueous potassium bromide solution (Solution 5) having the same concentration as Solution 4 was added while controlling so that the pBr was kept at 2.93. After the 5 minute-lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and 2-phenoxyethanol, and adjusted to pH 6.5. The emulsion grains formed in the foregoing manner were monodisperse silver bromide octahedrons having an edge length of 0.7 $\mu$m.

Emulsion 1-2: $[Fe(CN)_6]^{4-}$-doped Octahedral Silver Bromide Emulsion

Comparative Example

Emulsion 1-2 was prepared in the same manner as Emulsion 1-1, except that $[Fe(CN)_6]^{4-}$ was added to Solution 5 in an amount of $2.5\times10^{-4}$ mole per mole of silver added at this step. (The amount of silver added at this step corresponded to 25% of the total amount of silver added for preparation of the emulsion. The dopant added was introduced into a surface layer of each grain, and the dopant was introduced into the outer 75 to 100% of each grain volume.)

Emulsions 1-3 to 1-5: Octahedral Silver Bromide Emulsions Doped with $[Ru(bpy)_2Cl_2]^0$, $[Pd(CN)_3(py)]^-$ and $[Co(CN)_4(en)]^-$ Respectively

Comparative Examples

Emulsions 1-3 to 1-5 were prepared in the same manner as Emulsion I-1,except that $[Ru(bpy)_2Cl_2]^0$ (bpy=2,2'-bipyridine), $[Pd(CN)3(py)]^-$ (py=pyridine) and $[Co(CN)4(en)]^-$ (en=ethylenediamine) dissolved in separate portions of a 0.21 M aqueous KBr solution were each added simultaneously with not only Solution 3 but also Solution 4, followed by Solution 5, in accordance with a triple jet method. Therein, the addition of each complex solution was finished after a lapse of 15 minutes from the beginning of the addition of Solution 5, and the $[Ru(bpy)_2Cl_2]^0$, $[Pd(CN)_3(py)]^-$ and $[Co(CN)_4(en)]^-$ concentrations were each determined so that the ratio of each complex to the silver added at this triple jet step was $1\times10^{-4}$:1 by mole.

Emulsions 1-6 to 1-9: Octahedral Silver Bromide Emulsions Doped with Present Complexes

Present Invention

Emulsions 1-6 to 1-9 were prepared in the same manner as Emulsion 1-1, except that the complexes of the present invention, $[Co(acac)_3]^0$ (acac=acetylacetone), $[Ru(acac)_3]^0$, $[Ru(acac)_2Cl_2]^-$ and $[Ru(acac)Cl_4]^{2-}$ were dissolved in separate portions of a 0.21 M aqueous KBr solution, respectively, and each of these solutions was added simultaneously with not only Solution 3 but also Solution 4, followed by Solution 5, in accordance with a triple jet method. Therein, the addition of each complex solution was finished after a lapse of 15 minutes from the beginning of the addition of Solution 5, and the concentration of each complex was determined so that the ratio of each complex to the silver added at this triple jet step was $1\times10^{-4}$:1 by mole.

Each of the silver bromide Emulsions 1-1 to 1-9 was admixed with $8.0\times10^{-6}$ mole/mole Ag of sodium thiosulfate, $9.6\times10^{-6}$ mole/mole Ag of chloroauric acid and $3.4\times10^{-4}$ mole/mole Ag of potassium thiocyanate, and underwent optimal chemical sensitization at 60° C. Each of the thus chemically sensitized Emulsions 1-1 to 1-9 was spectrally sensitized with $4.9\times10^{-4}$ mole/mole Ag of Sensitizing Dye (1). After gelatin and sodium dodecylbenzenesulfonate were added thereto, each of these chemically and spectrally sensitized emulsions was coated at a silver coverage of 2 g/m$^2$ on a subbing layer-provided triacetyl cellulose film support by the use of an extrusion method, together with a protective layer containing gelatin, polymethyl methacrylate particles and sodium salt of 2,4-dichloro-6-hydroxy-s-triazine. Thus, coated Samples 1-1 to 1-9 were prepared.

Sensitizing Dye (1)

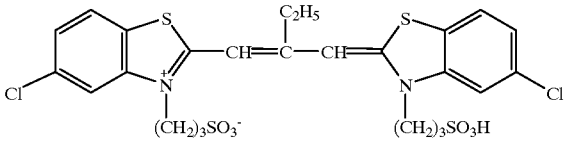

These Samples were each subjected to the exposure for sensitometry (1 second) via an optical wedge, and then developed for 10 minutes at 20° C. with Developer 1 prepared according to the formula described below.

Thereafter, each sample underwent sequentially usual stop, fixation, washing and drying operations, and then examined for optical density. The fog density was determined as the minimum optical density of each sample, and the sensitivity was represented by the reciprocal of an exposure amount required for providing the optical density of fog+0.1. The sensitivities of Samples are shown as relative values, with the dopant-free Sample being taken as 100. In Table II-1, there are shown relative sensitivities determined when the Samples 1-1 to 1-9 were each exposed to light of wavelengths at which the spectral sensitizing dye had absorption.

| Developer 1 | |
|---|---|
| Metol | 2.5 g |
| L-Ascorbic acid | 10.0 g |
| Nabox | 35.0 g |
| KBr | 1.0 g |
| Water to make | 1 liter |
| pH adjusted to | 9.6 |

TABLE II-1

| Sample No. | Emulsion No. | Dopant[a] | Relative sensitivity*1 one-second exposure |
|---|---|---|---|
| 1-1 (comparison) | 1-1 | not added | 100 |
| 1-2 (comparison) | 1-2 | $[Fe(CN)_6]^{4-}$ | 166 |
| 1-3 (comparison) | 1-3 | $[Ru(bpy)_2Cl_2]^0$ | 116 |
| 1-4 (comparison) | 1-4 | $[Pd(CN)_3(py)]^-$ | 126 |
| 1-5 (comparison) | 1-5 | $[Co(CN)_4(en)]^-$ | 79 |
| 1-6 (invention) | 1-6 | $[Co(acac)_3]^0$ | 189 |
| 1-7 (invention) | 1-7 | $[Ru(acac)_3]^0$ | 172 |
| 1-8 (invention) | 1-8 | $[Ru(acac)_2Cl_2]^-$ | 168 |
| 1-9 (invention) | 1-9 | $[Ru(acac)Cl_4]^{2-}$ | 166 |

[a]Symbols of ligands in each dopant, bpy, py, en and acac, mean 2,2'-bipyridine, pyridine, ethylenediamine and acethyl-acetone (2,4-pentanedion), respectively.
*1Relative value, with Sample 1-1 being taken as 100.

In Table II-1 are set forth sensitivities of the emulsions doped with the complexes of the present invention respectively. Therein, the layer comprising 90% of each silver bromide grain on a volume basis was doped with those complexes each. The emulsions doped with the complexes of the present invention having at least one acac ligand were all higher in sensitivity. Of the complexes according to the present invention, sensitivity increasing effect was great in particular when all the ligands contained in each dopant were the same. And the sensitivities achieved by the use of these dopants, exceeded the sensitivity achieved by the use of $[Fe(CN)_6]^{4-}$ which has so far used as a sensitivity-increasing dopant and those achieved by the use of complexes having large ligands, such as $[Ru(bpy)_2Cl_2]^0$ disclosed in JP-A-5-341426, $[Pd(CN)_3(py)]^-$ disclosed in JP-A-11-109537 and $[Co(CN)_4(en)]^-$ disclosed in U.S. Pat. No. 5,360,712.

EXAMPLE II-2

Emulsion 2-1: Preparation of Emulsion comprising Tabular Silver Iodobromide Grains having (111) Faces as Main Planes One liter of a dispersing medium solution (pH=5) containing 0.38 g of KBr and 0.5 g of low molecular weight gelatin (molecular weight: 15,000) was kept at 40° C. To this solution with stirring, 20 ml of a 0.29 M silver nitrate solution and 20 ml of a 0.29 M KBr solution were added over a 40-second period in accordance with a double jet method. After the addition, 15 minutes were spent in heating this dispersing medium solution up to 75° C. After a 15-minute lapse from such a heating operation, a dispersing medium solution containing 35 g of alkali-processed gelatin and 250 ml of water was further added. After adjusting the pH to 6.0, 734 ml of a 1.2 M silver nitrate solution was added at an accelerated flow rate. During this addition operation, a mixture of KBr and KI solutions was also added so that the pBr was kept at 2.93. Therein, the KI solution and the KBr solution were admixed in such amounts that the $I^-$ concentration was 3 mole % to the amount of silver added. The average projected area diameter of the thus prepared emulsion grains was 1.12 $\mu$m (variation coefficient: 16.2%), and the average thickness thereof was 0.15 $\mu$m. Additionally, the average projected area diameter and the average thickness of tabular grains can be determined from electron microphotographs according to the method described in U.S. Pat. No. 4,434,226.

Emulsions 2-2 and 2-3: Emulsions Comprising Tabular Silver Iodobromide Grains Doped with $[Ru(CN)_6]^{4-}$ and $[Ru(bpy)_2Cl_2]^0$ Respectively

Comparative Examples

Emulsions 2-2 and 2-3 were prepared by adding to Emulsion 2-1 the dopants $[Ru(CN)_6]^{4-}$ and $[Ru(bpy)_2Cl_2]^0$ in amounts of $1\times10^{-4}$ mole and $2.5\times10^{-4}$ mole, respectively per mole of silver contained in the emulsion grains as a whole so that those complexes were each introduced into a part corresponding to 80 to 100% of each grain on a volume basis.

Emulsions 2-4 and 2-5: Emulsions Comprising Tabular Silver Iodobromide Grains Doped with $[Co(acac)_3]^0$ and $[Ru(acac)_3]^0$ Respectively

Present Invention

Emulsions 2-4 and 2-5 were prepared by adding to Emulsion 2-1 the complexes of the present invention, $[Co(acac)_3]^0$ and $[Ru(acac)_3]^0$ in amounts of $5\times10^{-5}$ mole and $2\times10^{-5}$ mole respectively per mole of silver contained in the emulsion grains as a whole so that those complexes were each introduced into a part corresponding to 80 to 100% of each grain on a volume basis.

Each of the Emulsions 2-1 to 2-5 was admixed with $8.0\times10^{-6}$ mole/mole Ag of sodium thiosulfate, $3\times10^{-6}$ mole/mole Ag of chloroauric acid and $3\times10^{-6}$ mole/mole Ag of potassium thiocyanate, and underwent optimal chemical sensitization at 60° C. Each of these chemically sensitized emulsions was coated in the same manner as in Example II-1, thereby preparing coated Samples 2-1 to 2-5.

These Samples were each subjected to the exposure for sensitometry ($10^{-2}$ second) via an optical wedge, and then developed by the same method as in Example II-1.

Thereafter, each sample was subjected sequentially to usual stop, fixation, washing and drying operations, and then examined for optical density. The sensitivities of the coated Samples (spectral sensitizing dye-free samples) set forth in Table II-2 are relative sensitivities determined when the samples were each exposed to light of wavelengths at which the silver halide therein showed the intrinsic absorption.

TABLE II-2

| Sample No. | Emulsion No. | Dopant[a] | Amount added (mol/mol Ag) | Relative sensitivity *1 ($10^{-2}$ sec exposure |
|---|---|---|---|---|
| 2-1 (comparison) | 2-1 | not added | — | 100 |
| 2-2 (comparison) | 2-2 | $[Ru(CN)_6]^{4-}$ | $1 \times 10^{-4}$ | 105 |
| 2-3 (comparison) | 2-3 | $[Ru(bpy)_2Cl_2]^0$ | $2.5 \times 10^{-4}$ | 106 |
| 2-4 (invention) | 2-4 | $[Co(acac)_3]^0$ | $5 \times 10^{-5}$ | 127 |
| 2-5 (invention) | 2-5 | $[Ru(acac)_3]^0$ | $5 \times 10^{-5}$ | 118 |

[a]Symbols of ligands in each dopant, bpy and acac, mean 2,2'-bipyridine and acethylacetone (2,4-pentanedione) respectively.
*1 Relative values, with Sample 2-1 being taken as 100.

The complexes $[Co(acac)_3]^0$ and $[Ru(acac)_3]^0$, whose great sensitivity-increasing effect upon octahedral silver bromide emulsions are demonstrated in Table II-1, were also used for doping a tabular grain emulsion. As a result, it has been proved that the tabular grain emulsions also had greatly increased sensitivities when doped with those complexes, compared with the case where they were doped with the complex $[Ru(CN)_6]^{4-}$ or $[Ru(bpy)_2Cl_2]^0$ hitherto known to cause a considerable increase in sensitivity. The greatest sensitivity-increasing effect was produced in the tabular grain emulsion doped with $[Co(acac)_3]^0$.

EXAMPLE II-3

Emulsion II-3: Tabular Silver Iodobromide Emulsion Doped with Present Complex $[Co(acac)_3]^0$ Emulsion 2-4 prepared in Example II-2 was subjected to optimal chemical sensitization, further to spectral sensitization, and then used as the emulsion for the third layer of the sensitive material Sample 201 in Example 2 of JP-A-9-146237. The thus prepared sensitive material was subjected to the same photographic processing as in the example of the reference described above, and produced satisfactory results.

EXAMPLE II-4

Emulsion II-4: Tabular Silver Iodobromide Emulsion Doped with Present Complex $[Co(acac)_3]^0$ Emulsion 2-4 prepared in Example II-2 was subjected to optimal chemical sensitization, further to spectral sensitization, and then used as the emulsion for the third layer of the sensitive material Sample 110 in Example 1 of JP-A-10-20462. The thus prepared sensitive material was subjected to the same photographic processing as in the example of the reference described above, and produced satisfactory results.

Effect of the Invention

As seen from the results obtained in Examples, doping silver halide emulsion grains with the complexes of the present invention can ensure higher sensitivity and far less intrinsic desensitization for silver halide photosensitive materials than no doping or doping with the existing dopants such as hexacyano complexes.

While the present invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing at least one complex comprising at least one ligand, wherein said ligand is a compound represented by the following formula (I):

(I)

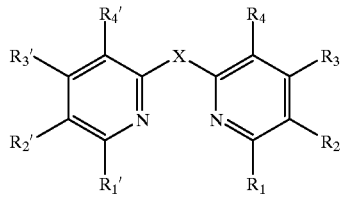

wherein X represents a group containing a chalcogen atom, a phosphorus atom, a silicon atom or a gold atom, ethylene, a secondary alcohol or ketone, each of $R_1$ to $R_4$ represents a hydrogen atom or a substituent group, and each of $R_1'$ to $R_4'$ represents a hydrogen atom or a substituent group.

2. The silver halide photographic emulsion as in claim 1, wherein said complex is a metal complex containing organic compounds, wherein said organic compounds are in a state that they are bound respectively to more than half of coordination sites of a central metal of said metal complex, and at least one of said organic compounds is at least one ligand represented by formula (I).

3. A silver halide photographic emulsion containing at least one complex comprising at least one ligand represented by the following formula (I), wherein the complex having at least one ligand is a complex represented by the following formula (II), (III) or (IV):

$$[M(L)_3]^n \quad \text{(II)}$$

$$[M(L)_2L']^n \quad \text{(III)}$$

$$[M(L)_2Y_2]^n \quad \text{(IV)}$$

wherein M represents a metal or a metal ion, L represents the ligand of formula (I), L' represents a bidentate ligand, Y represents monodentate ligand, and n represents an integer of from −6 to 6;

(I)

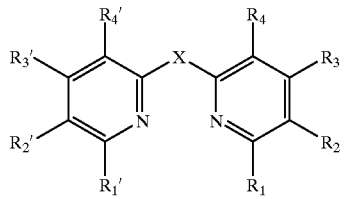

wherein X represents an atom or atomic group bridging two pyridine rings, each of $R_1$ to $R_4$ represents a hydrogen atom or a substituent group, and each of $R_1'$ to $R_4'$ represents a hydrogen atom or a substituent group.

4. The silver halide photographic emulsion as in claim 3, wherein the X in formula (I) comprises an atom or atomic group selected from the group consisting of carbon, nitrogen, sulfur, phosphorus, silicon, selenium and tellurium atoms and structured so as to bridge the two pyridine rings.

5. The silver halide photographic emulsion as in claim 4, wherein the X in formula (I) is a group selected from methylene, amine, sulfide, sulfoxide, phosphine, silane, selenide, telluride, secondary alcohol, ketone or aminoalkyl.

6. The silver halide photographic emulsion as in claim 5, wherein the central metal M in each of formulae (II) to (IV) is a metal or a metal ion selected from the group consisting of iron, ruthenium, cobalt, nickel, copper and ions of these metals.

7. The silver halide photographic emulsion as in claim 3, wherein the complex having at least one ligand is a complex represented by the formula (II).

8. The silver halide photographic emulsion as in claim 3, wherein the complex having at least one ligand is a complex represented by the formula (III).

9. The silver halide photographic emulsion as in claim 3, wherein the complex having at least one ligand is a complex represented by the formula (IV).

10. A silver halide photographic emulsion containing at least one complex comprising at least one ligand, wherein said ligand is a diketone compound.

11. The silver halide photographic emulsion as in claim 10, wherein said complex is incorporated in the silver halide emulsion and said complex comprises a diketone compound which coordinates as a bidentate ligand to a central metal ion of the complex via oxygen atoms in ketone moieties thereof.

12. The silver halide photographic emulsion as described in claim 11, wherein the complex incorporated in the silver halide emulsion is a complex containing at least two molecules of the diketone compound as ligands thereof.

13. The silver halide photographic emulsion as described in claim 12, wherein the diketone compound contained as ligands in the complex is a β-diketone or a γ-diketone.

14. The silver halide photographic emulsion as described in claim 13, wherein the diketone compound contained as ligands in the complex is a β-diketone.

15. The silver halide photographic emulsion as described in claim 14, wherein the complex incorporated in the silver halide emulsion is a complex whose central metal is a metal or a metal ion selected from the group consisting of alkaline earth metals, the first transition series metals, the second transition series metals, lanthanide metals, iridium, platinum, zinc, aluminum, tin and ions of these metals.

16. The silver halide photographic emulsion as described in claim 15, wherein the complex incorporated in the silver halide emulsion is a complex containing three molecules of the β-diketone as ligands thereof.

17. The silver halide photographic emulsion as described in claim 16, wherein the complex incorporated in the silver halide emulsion is a complex whose ligands are acetylacetone molecules and whose central metal is a metal or metal ions selected from the group consisting of alkaline earth metal, vanadium, manganese, iron, cobalt, nickel, palladium, platinum, gold, zinc, titanium, chromium (exclusive of chromium (II)), osmium, cadmium, mercury, yttrium, ruthenium, rhodium, lanthanum, cerium, praseodymium, europium, gadolinium, dysprosium, holmium, erbium, ytterbium, iridium, copper, and aluminum and ions of these metals.

* * * * *